US007789029B2

(12) United States Patent
Tashiro

(10) Patent No.: US 7,789,029 B2
(45) Date of Patent: Sep. 7, 2010

(54) SEWING DATA CREATION APPARATUS AND COMPUTER-READABLE RECORDING MEDIUM STORING A SEWING DATA CREATION PROGRAM

(75) Inventor: Noriharu Tashiro, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 490 days.

(21) Appl. No.: 11/987,363

(22) Filed: Nov. 29, 2007

(65) Prior Publication Data

US 2008/0127870 A1 Jun. 5, 2008

(30) Foreign Application Priority Data

Nov. 30, 2006 (JP) ..... 2006-324781

(51) Int. Cl.
*D05B 21/00* (2006.01)
*D05B 19/08* (2006.01)
*D05C 9/06* (2006.01)

(52) U.S. Cl. ..... 112/470.01; 112/102.5; 700/137

(58) Field of Classification Search ..... 112/2, 112/102, 102.5, 470.1–470.7, 475.19; 700/136–138
See application file for complete search history.

(56) References Cited

U.S. PATENT DOCUMENTS 4,388,883 A 6/1983 Hirota et al.
4,413,574 A 11/1983 Hirota et al.
4,499,838 A * 2/1985 Voza ..... 112/475.19
5,189,623 A 2/1993 Komuro et al.
5,261,341 A * 11/1993 Asano ..... 112/102.5
5,283,748 A 2/1994 Muramatsu
5,839,380 A * 11/1998 Muto ..... 112/102.5
5,867,391 A * 2/1999 Muto ..... 700/137
5,957,068 A * 9/1999 Mizuno ..... 112/102.5
5,960,726 A 10/1999 Yamada
6,098,559 A * 8/2000 Hirose ..... 112/475.19

(Continued)

FOREIGN PATENT DOCUMENTS

JP A 04-240474 8/1992

(Continued)

OTHER PUBLICATIONS

Apr. 5, 2010 Office Action issued in U.S. Appl. No. 11/987,366.

*Primary Examiner*—Ismael Izaguirre
(74) *Attorney, Agent, or Firm*—Oliff & Berridge, PLC

(57) ABSTRACT

A sewing data creation apparatus for creating sewing data used for sewing by a sewing machine, the apparatus may include a profile line network creation device that creates a profile line network. The apparatus may further include a starting point-and-ending point determination device that determines a starting point and an ending point of the stitch path. Further, a path creation device that creates the stitch path, a movement determination device that determines whether a partial path may be moved, a movement device that moves the partial path, an adjustment device that adjusts the stitch path by causing the movement device to move the partial path until there is no more partial path determined to be moved by the movement determination device and a sewing data creation device that creates the sewing data used to form stitches on the stitch path adjusted by the adjustment device may also be included.

22 Claims, 40 Drawing Sheets

U.S. PATENT DOCUMENTS

| | | | | |
|---|---|---|---|---|
| 6,161,491 | A * | 12/2000 | Takenoya et al. | 112/102.5 |
| 6,430,460 | B1 * | 8/2002 | Taguchi | 700/138 |
| 6,629,015 | B2 | 9/2003 | Yamada | |
| 6,968,255 | B1 | 11/2005 | Dimaridis et al. | |
| 7,680,558 | B2 * | 3/2010 | Yamada | 700/138 |

FOREIGN PATENT DOCUMENTS

| | | |
|---|---|---|
| JP | A 07-289760 | 11/1995 |
| JP | A 08-084876 | 4/1996 |
| JP | A 09-137357 | 5/1997 |
| JP | B2 2867713 | 12/1998 |
| JP | B2 3499607 | 12/2003 |

* cited by examiner

FIG. 21

800

| | | | | | | |
|---|---|---|---|---|---|---|
| SCHEMATIC DIAGRAM | 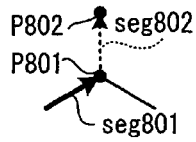 | | 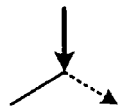 | | 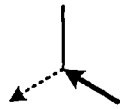 | |
| COORDINATE | x | y | x | y | x | y |
| INITIAL STITCH PATH | LARGE | SMALL | = | LARGE | SMALL | SMALL |
| SELECTED SIDE LINE SEGMENT | = | SMALL | LARGE | LARGE | SMALL | LARGE |
| SCHEMATIC DIAGRAM | 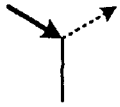 | | 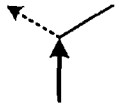 | | 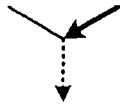 | |
| COORDINATE | x | y | x | y | x | y |
| INITIAL STITCH PATH | LARGE | LARGE | = | SMALL | SMALL | LARGE |
| SELECTED SIDE LINE SEGMENT | LARGE | SMALL | SMALL | SMALL | = | LARGE |
| SCHEMATIC DIAGRAM | 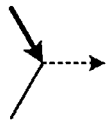 | | 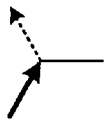 | | 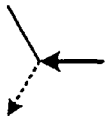 | |
| COORDINATE | x | y | x | y | x | y |
| INITIAL STITCH PATH | LARGE | LARGE | LARGE | SMALL | SMALL | = |
| SELECTED SIDE LINE SEGMENT | LARGE | = | SMALL | SMALL | SMALL | LARGE |
| SCHEMATIC DIAGRAM | 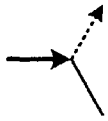 | | 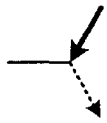 | | 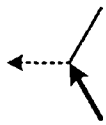 | |
| COORDINATE | x | y | x | y | x | y |
| INITIAL STITCH PATH | LARGE | = | SMALL | LARGE | SMALL | SMALL |
| SELECTED SIDE LINE SEGMENT | LARGE | SMALL | LARGE | LARGE | SMALL | = |

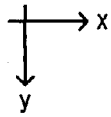

RELATED ART

SEWING DATA CREATION APPARATUS AND COMPUTER-READABLE RECORDING MEDIUM STORING A SEWING DATA CREATION PROGRAM

CROSS-REFERENCE TO RELATED APPLICATION

This application claims priority from Japanese Patent Application No. 2006-324781, filed Nov. 30, 2006, the disclosure of which is hereby incorporated by reference in its entirety.

BACKGROUND

The present disclosure generally relates to technical fields including a sewing data creation apparatus and a sewing data creation program recorded on a computer-readable recording medium. More specifically, the disclosure relates to a sewing data creation apparatus and sewing data creation program recorded on a computer-readable recording medium, both of which create sewing data required to form stippling stitches.

Conventionally, a stippling stitch has been known as one type of quilting stitch. In a quilting process, an inner cotton is placed between a main fabric and a lining and are sewn together with a stitch pattern such as a line or a curve. For example, a stitch 902 shown in FIG. 40 is a stippling stitch, which is sewn to form a design to fill a sewing area 901 prepared for stitching. The stippling stitch is formed in a complicated curve such that the curve does not intersect itself. Conventionally, most decorative patterns such as the stippling stitch have been sewn by hand, whereas recently, a sewing machine has been used.

However, it is not preferable for a stippling stitch to cross itself, a part of the stitch line is too close to other parts of the stitch, the stitch line creates high density portion and low density portion in a sewing area, the stitch line has stitches with uneven stitch lengths, or the stitch line forms a curve with a pointed portion. In other words, it is preferable that the stitch line creates a smooth curve that is well balanced and evenly arranged in a sewing area, does not intersect itself, or has no part too close to other parts, and have uniform stitch lengths.

Further, an embroidery data creation apparatus is known that transforms a part of a profile line of an embroidery pattern to be sewn into a Bezier curve (see, for example, Japanese Patent Application Laid Open Publication No. Hei 9-137357).

SUMMARY

However, there has been a problem that a sewing operator needs to have high skills to sew a stitch line by a sewing machine while moving a cloth by hand, in such a manner that the stitch line makes a curve which is smooth, well-balanced, and evenly arranged in the sewing area, does not intersect itself or has no part too close to other parts, and has uniform stitch lengths. Further, a conventional embroidery data creation apparatus only changes a profile line of an embroidery design into curves and may not evenly arrange required stitches in the embroidery design in a balanced manner.

Various exemplary embodiments of the broad principles derived herein provide a sewing data creation apparatus and a sewing data creation program recorded on a computer-readable recording medium that may create sewing data required to easily sew a stippling stitch with a sewing machine.

Exemplary embodiments provide a sewing data creation apparatus for creating sewing data used for sewing by a sewing machine, including a profile line network creation device that continuously arranges unit areas with a predetermined shape in a sewing area to create a profile line network, the profile line network being an aggregate of profile lines of the arranged unit areas, the profile line network providing a basis for creating the stitch path, a starting point-and-ending point determination device that determines a starting point and an ending point of the stitch path from a plurality of points on the profile line network, a path creation device that creates the stitch path by connecting the starting point and the ending point on the profile line network without intersecting, a movement determination device that determines whether a partial path may be moved in such a manner as to be routed longer on the profile line of at least one unit area where the partial path is disposed, the partial path being a part of the stitch path created by the stitch path creation device and continuously disposed on the profile line of at least one of the unit areas, a movement device that moves the partial path determined to be moved by the movement determination device on the profile line of the at least one unit area, an adjustment device that adjusts the stitch path by causing the movement device to move the partial path until there is no more partial path determined to be moved by the movement determination device, and a sewing data creation device that creates the sewing data used to form stitches on the stitch path adjusted by the adjustment device adjustment device.

Exemplary embodiments also provide a computer-readable recording medium storing a program for creating sewing data used for sewing by a sewing machine including instructions that cause a controller to execute profile line network creation instructions for continuously arranging unit areas with a predetermined shape in an entire sewing area to thus creating a profile line network, the profile line network being an aggregate of profile lines of the unit areas and provides a basis for creating a stitch path, starting point-and-ending point determination instructions for determining a starting point and an ending point of the stitch path from among points on the profile line network, path creation instructions for creating the stitch path by connecting the starting point and the ending point on the profile line network without intersecting, movement determination instructions for determining whether a partial path may be moved in such a manner as to be routed longer on the profile line of the at least one unit area where the partial path is disposed, is the partial path being a part of the stitch path created in the path creation instructions and continuously disposed on the profile line of at least one of the unit areas, movement instructions for moving the partial path determined to be moved in the movement determination instructions in such a manner that the partial path is routed longer on the profile line of the at least one unit area, adjustment instructions for adjusting the stitch path by repeating the movement step to move the partial path until there is no more partial path determined to be moved in the movement determination step; and sewing data creation instructions for creating the sewing data used to form stitches on the stitch path adjusted in the adjustment step.

BRIEF DESCRIPTION OF THE DRAWINGS

Exemplary embodiments will be described below in detail with reference to the accompanying drawings in which:

FIG. 21 is a schematic diagram showing various cases of selecting a first candidate for the next branch point.

DETAILED DESCRIPTION OF EMBODIMENTS

Hereinafter a sewing data creation apparatus 1 according to exemplary embodiments will be described with reference to drawings. The sewing data creation apparatus 1 may create sewing data used to form a stippling stitch by an embroidery sewing machine 3 in an area specified as a sewing area.

Figure 1:
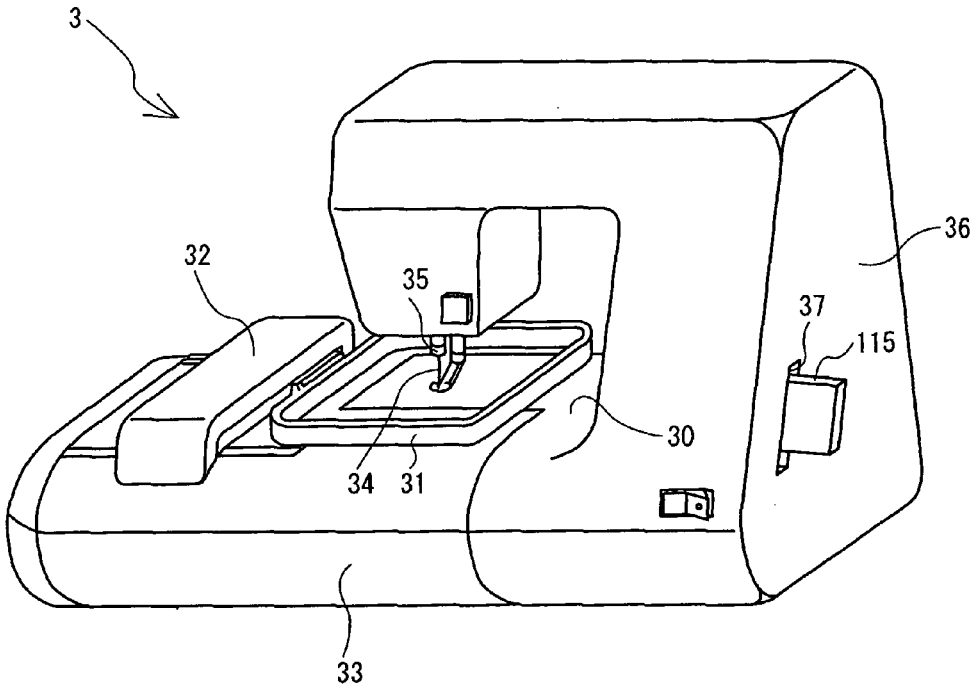
FIG. 1 is an external view of an embroidery sewing machine.

First, the embroidery sewing machine 3 is described below. The embroidery sewing machine 3 shown in FIG. 1 may include a needle bar mechanism (not shown) that may vertically drive a needle bar 35 to which a sewing needle 34 is attached, a thread take-up mechanism (not shown), and a shuttle mechanism (not shown). The embroidery sewing machine 3 may further include a Y-directional drive mechanism (not shown) and an X-directional drive mechanism (not shown). The Y-directional drive mechanism may shift an embroidery frame 31 placed on a sewing machine bed 30 that may hold a work cloth (not shown) for sewing in a cross direction of the embroidery sewing machine 3 (cross direction of the paper). The X-directional drive mechanism may shift the Y-directional drive mechanism in a right-and-left direction of the embroidery sewing machine 3 (right-and-left direction of the paper). The Y-directional drive mechanism may be housed in a carriage cover 32 and the X-directional drive mechanism may be housed in a body case 33. The embroidery sewing machine 3 may perform sewing by means of cooperation of the needle bar mechanism, the thread take-up mechanism and the shuttle mechanism, while moving the embroidery frame 31 by the Y-directional and X-directional drive mechanisms, and may thereby forming stitches of a predetermined design on the work cloth. A sewing machine motor (not shown) that may drive the needle bar mechanism, the thread take-up mechanism, and the shuttle mechanism and the motors (not shown), and may respectively drive the Y-directional and X-directional drive mechanisms, may be controlled by a control device including a microcomputer built in the embroidery sewing machine 3. Further, the embroidery sewing machine 3 may include a memory card slot 37 formed on a side surface of its pillar 36. By inserting a memory card 115, for example, storing embroidery data into the memory card slot 37, the embroidery data that has been created in the embroidery data creation apparatus 1 may be supplied to the embroidery sewing machine 3. Alternatively, the embroidery sewing machine 3 and the embroidery data creation apparatus 1 may be connected to each other with a cable, thereby directly supplying the embroidery data.

Figure 2:
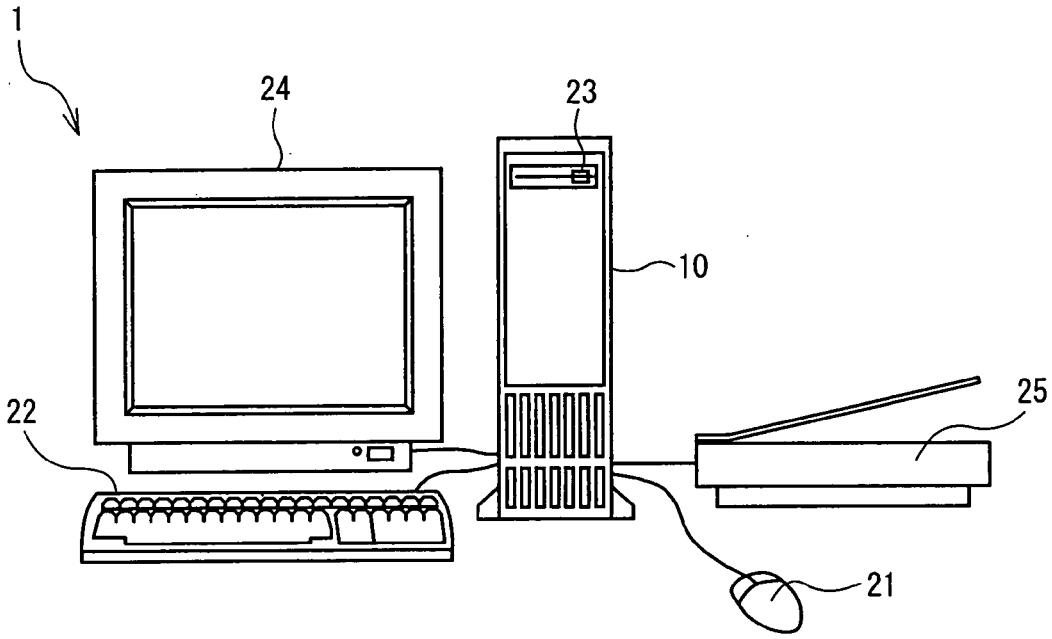
FIG. 2 is an overall configuration diagram of a physical configuration of a sewing data creation apparatus.
Figure 3:
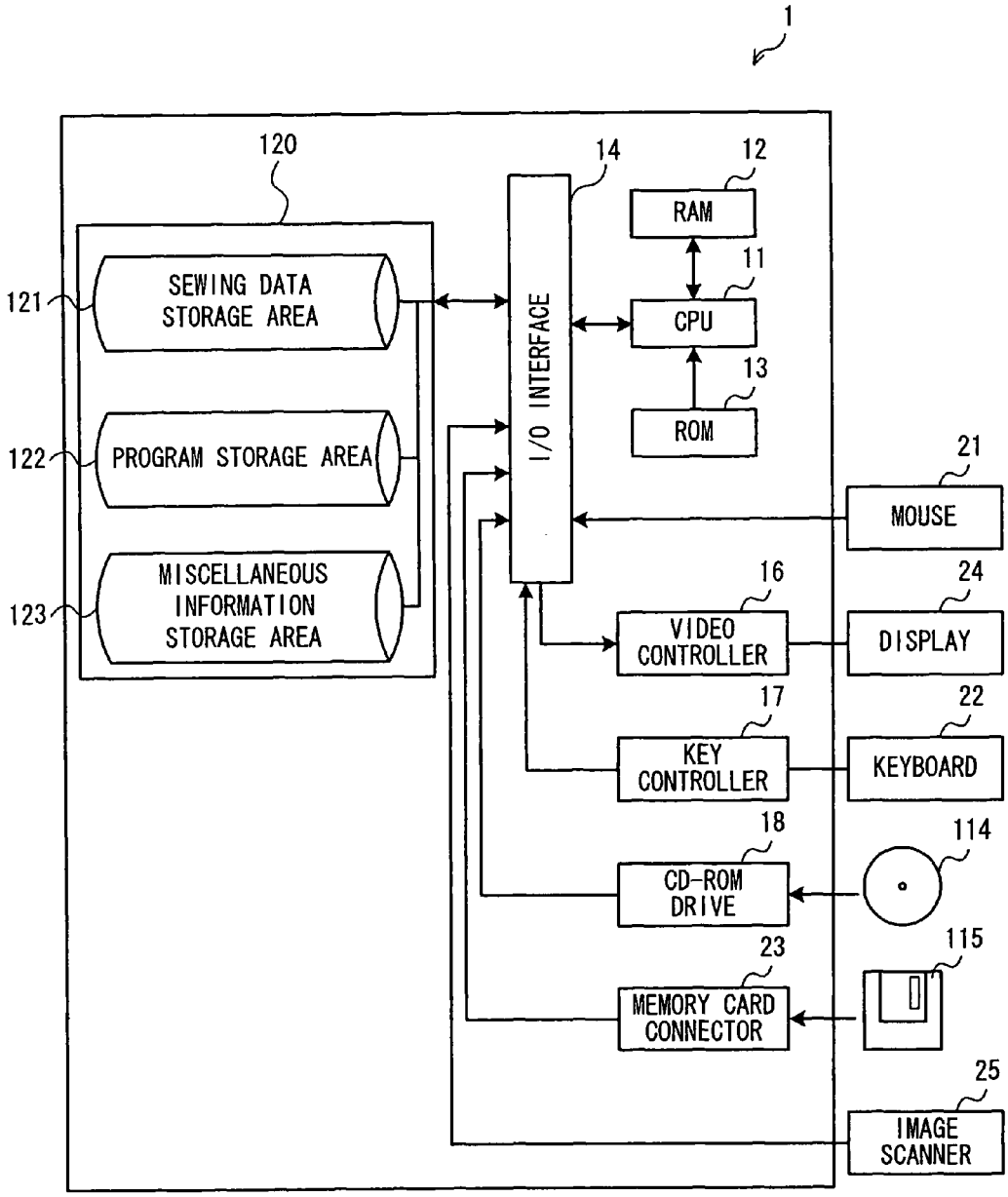
FIG. 3 is a block diagram of an electrical configuration of the sewing data creation apparatus.
Figure 4:
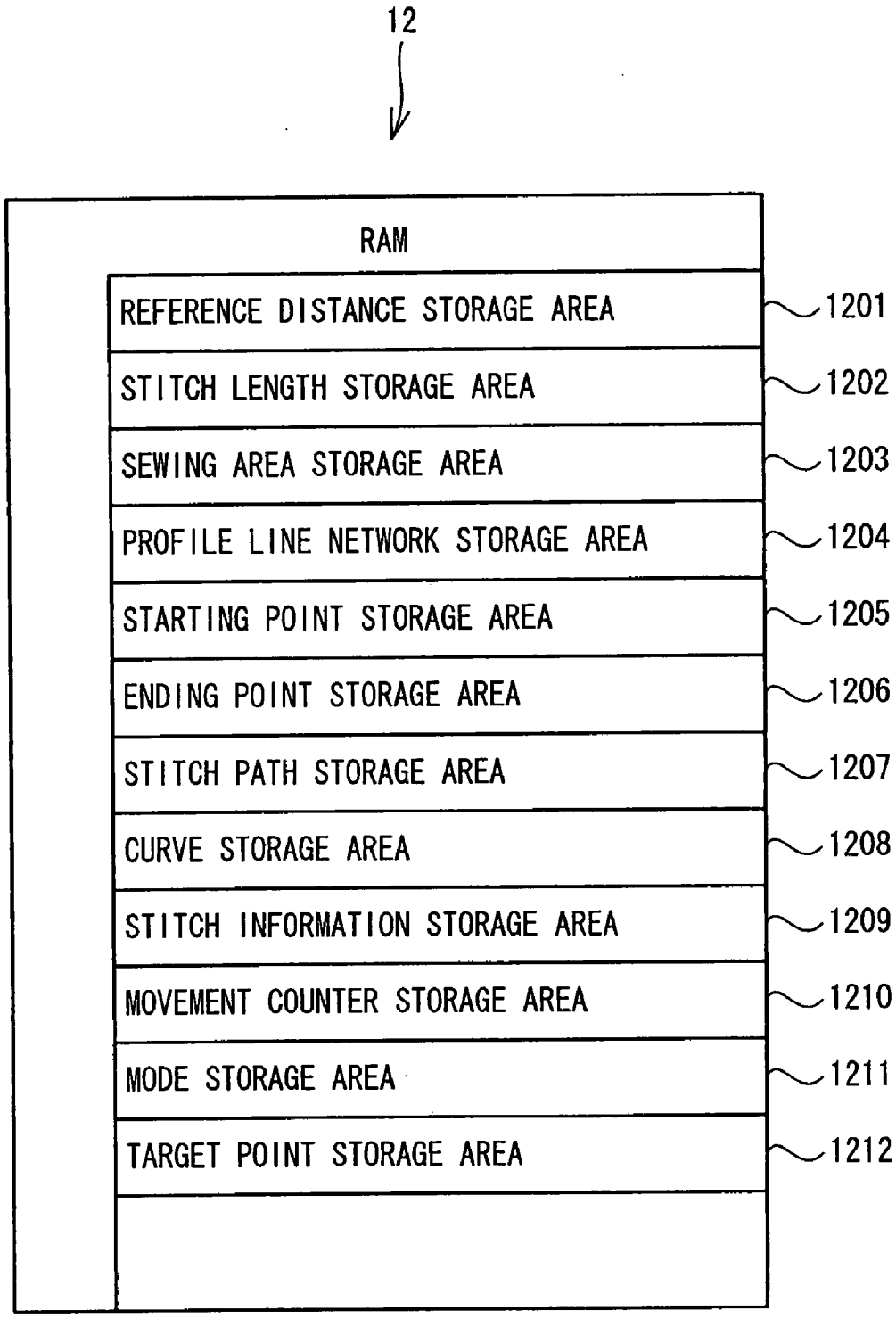
FIG. 4 is a schematic diagram of a configuration of a RAM.

Next, the embroidery data creation apparatus 1 will be described below with reference to FIGS. 2-4. As shown in FIG. 2, the embroidery data creation apparatus 1 may include an apparatus body 10, which may be a so-called personal computer. A mouse 21, a keyboard 22, a memory card connector 23, a display 24, and an image scanner 25, each of which may be connected to the apparatus body 10. The shapes of the apparatus body 10, the mouse 21, the keyboard 22, the memory card connector 23, the display 24, and the image scanner 25 are not limited to those shown in FIG. 2. For example, the apparatus body 10 may not only be a tower type, but may also be a transverse-mounted type or further may be of a notebook type in which the display 24 and the keyboard 22 are integrated. Further, rather than being a so-called personal computer, the apparatus body 10 may be a dedicated one. Further, the image scanner 25, if not used, need not be connected to the embroidery data creation apparatus 1.

Next, the electrical configuration of the embroidery data creation apparatus 1 will be described below with reference to a block diagram in FIG. 3. As shown in FIG. 3, the embroidery data creation apparatus 1 may include a CPU 11 serving as a controller which controls on the embroidery data creation apparatus 1. A RAM 12 that may temporarily store a variety of kinds of data, a ROM 13 that may store the BIOS, etc., and an I/O interface 14 that may mediate delivery and receipt of data may be connected to the CPU 11. A hard disk drive 120 may be connected to the I/O interface 14. The hard disk drive 120 may include sewing data storage area 121, a program storage area 122, and a miscellaneous storage area 123.

The sewing data storage area 121 may store sewing data created by the sewing data creation program and to be read into the embroidery sewing machine 3. The program storage area 122 may store the sewing data creation program to be executed by the CPU 11. The miscellaneous information storage area 123 may store other information to be used in the sewing data creation apparatus 1. The program may be stored in the ROM 13, for example, if the sewing data creation apparatus 1 is a dedicated apparatus not equipped with the hard disk drive 120.

The mouse 21, a video controller 16, a key controller 17, a CD-ROM drive 18, a memory card connector 23, and the image scanner 25 may be connected to the I/O interface 14. The video controller 16 is connected the display 24, and to the key controller 17 is connected the keyboard 22. It should be noted that the CD-ROM 114, which may be inserted into the CD-ROM drive 18 may store the sewing data creation program, which is a control program for the sewing data creation apparatus 1. At the time of introduction, the control program may be set up from the CD-ROM 114 to the hard disk drive 120 and may be stored in the program storage area 122. Further, through the memory card connector 23, information may be read from and written into the memory card 115.

Next, the storage areas provided in the RAM 12 will be described below with reference to FIG. 4. As shown in FIG. 4, the RAM 12 may have a reference distance storage area 1201, a stitch length storage area 1202, a sewing area storage area 1203, a profile line network storage area 1204, a starting point storage area 1205, an ending point storage area 1206, a stitch path storage area 1207, a curve storage area 1208, a stitch information storage area 1209, a movement counter storage area 1210, a mode storage area 1211, a target point storage area 1212. The RAM 12 may further be provided with other various storage areas.

Figure 9:
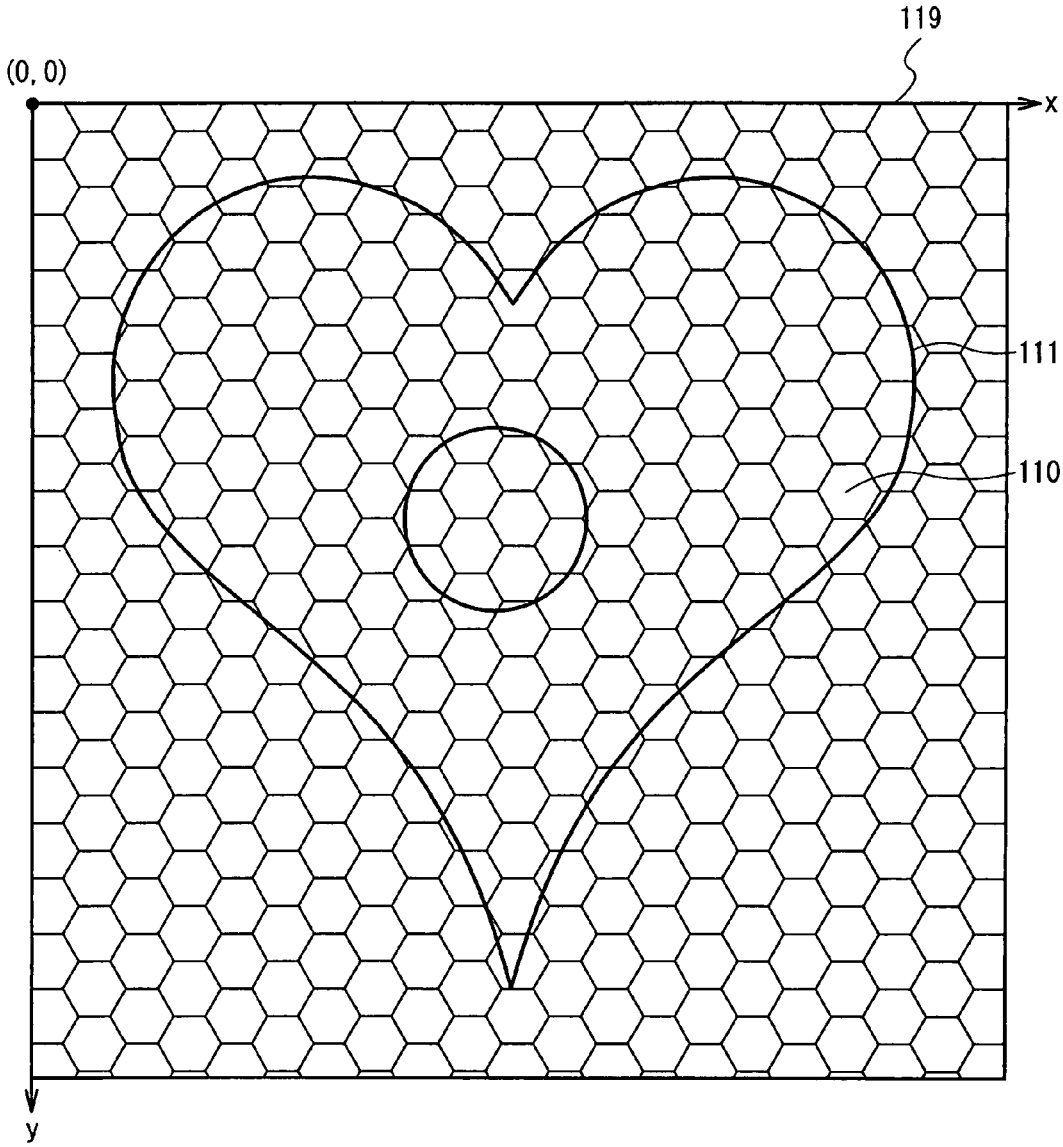
FIG. 9 is a schematic diagram of a process for disposing a profile line network in the sewing area.

The reference distance storage area 1201 may store a reference distance, which may be used as a reference when determining the size of a unit area (see FIG. 9). The stitch length storage area 1202 may store a stitch length when stitches are sewn. The sewing area storage area 1203 may store a sewing area, that is, an area where sewing may be performed. The profile line network storage area 1204 may store coordinate information of points and connection information between the points, which may indicate a profile line network (see FIG. 9). The profile line network may be formed by arranging unit areas with a predetermined shape in a sewing area and connecting the profile lines of the unit areas. The starting point storage area 1205 and the ending point storage area 1206 may respectively store coordinates of a starting point and an ending point, which may be specified by a user in the sewing area. The stitch path storage area 1207 may store information indicating a stitch path (path for sewing) set on the profile line network. This information may be coordinates of branch points on the stitch path in order from the starting point to the ending point. The curve storage area 1208 may store information indicating a curve path obtained by transforming the stitch path. This information may be coordinates of a plurality of points that form the curve path. The stitch information storage area 1209 may store information indicating stitches to be disposed on the curve path. This information may be coordinates of needle drop points for the stitches. The movement counter storage area 1210 may store a value of a movement counter, which may be used when creating the stitch path. The mode storage area 1211 may store a value that indicates a mode, which may be employed when creating the stitch path. The target point storage area 1212 may store a value that indicates a branch point, which may be focused on as a target point when moving a stitch path.

Figure 5:
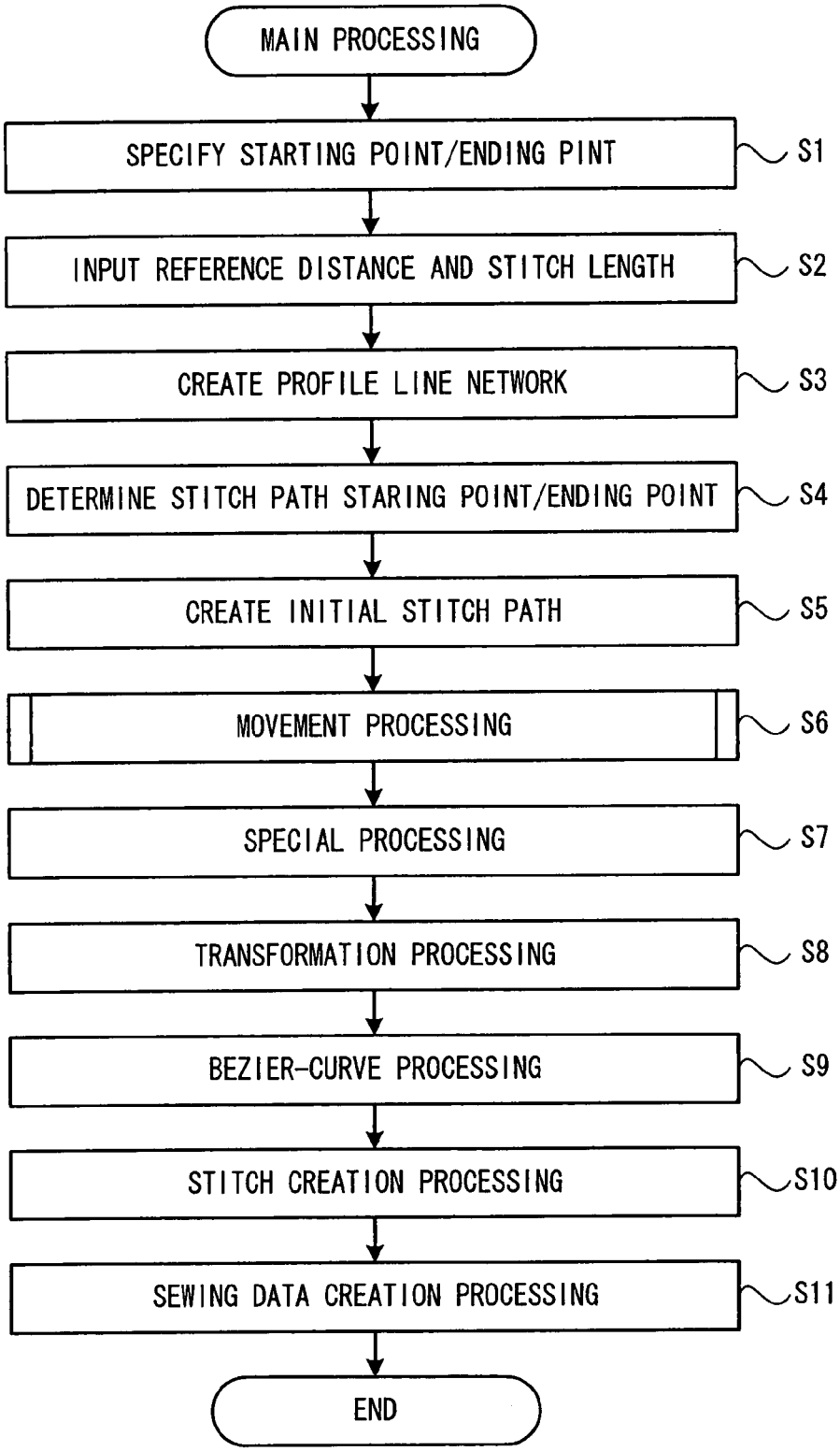
FIG. 5 is a flowchart of main processing by the sewing data creation apparatus.
Figure 7:
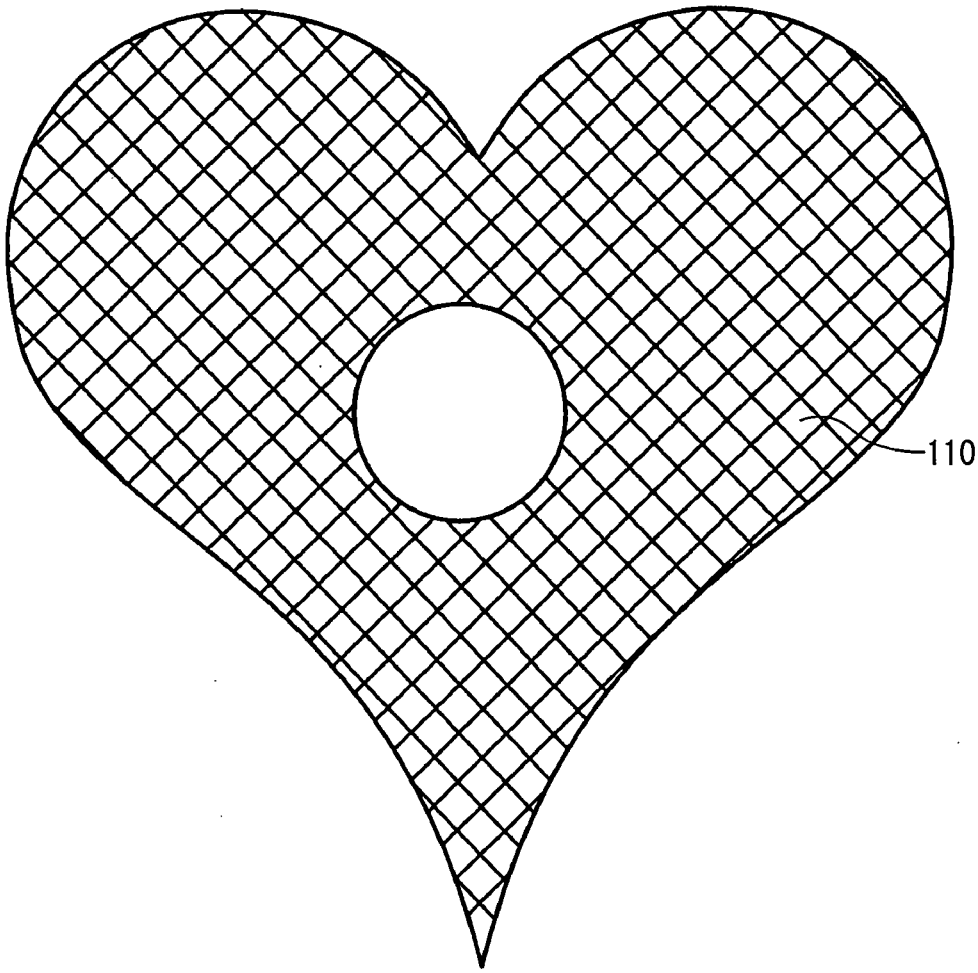
FIG. 7 is a schematic diagram of a sewing area.
Figure 8:
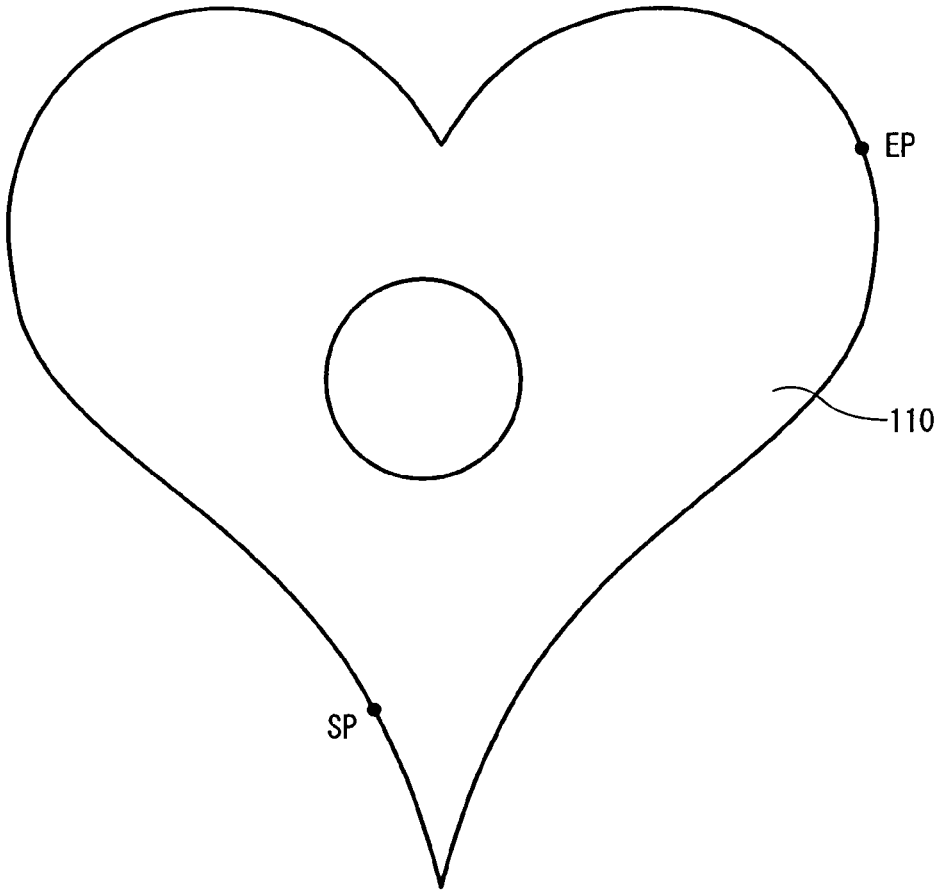
FIG. 8 is a schematic diagram of a starting point and an ending point of the sewing area.

Next, operations of the sewing data creation apparatus 1 will be described below with reference to FIGS. 5-14. In particular, the operations will be described here from a process of disposing a stitch path 410 in a sewing area to a process of creating a curve path 610 on which stitches may be disposed based on the stitch path. In the following description, an overall sewing area 110 with the shape of a heart from which a circular hole is cut out as shown in FIG. 7 may be employed as an example. Processing described below may be performed by the CPU 11 in accordance with the sewing data creation program, which may be stored in the program storage area 122. As shown in FIG. 5, a starting point and an ending point may be specified first (S1). For example, a screen showing the sewing area may be displayed on the display 24, with a message to prompt a user to enter the starting point. If the user clicks the mouse at an arbitrary point on the profile line of the sewing area in accordance with the message, the starting point may be specified, so that the information of coordinates indicating the position where the mouse was clicked may be stored in the starting point storage area 1205. As for an ending point, similarly, if the user clicks the mouse at an arbitrary point on the profile line of the sewing area in accordance with the message that prompts the entry of the ending point, the ending point may be specified. Then, the coordinate information indicating the position where the mouse was clicked may be stored in the ending point storage area 1206. Here, it is supposed that such positions as shown in FIG. 8 have been specified as a starting point SP and an ending point EP. In the drawings showing the sewing area, it is supposed that the horizontal direction and the vertical direction may be set as an X-axis and Y-axis respectively, and a coordinate system may be given where the x-axis value increases rightward and the y-axis value increases downward.

Subsequently, entry of a reference distance and a stitch length is accepted (S2). For example, an entry screen for the reference distance and the stitch length may be displayed, values entered into respective input fields by the user may be accepted, and the values of the reference distance and the stitch length may respectively be stored in the reference distance storage area 1201 and in the stitch length storage area 1202.

Subsequently, a profile line network 210 may be created (S3). For example, first, a size of the unit area may be determined based on a reference distance stored in the reference distance storage area 1201. For example, the length of the unit area may be determined as (reference distance)/1.5. In an exemplary embodiment, the unit area may be a regular hexagon and the length of its side may be (reference distance)/1.5. As shown in FIG. 9, the unit areas with the determined size may be disposed in a coordinate system 119, which may indicate the sewing area 110.

Figure 10:
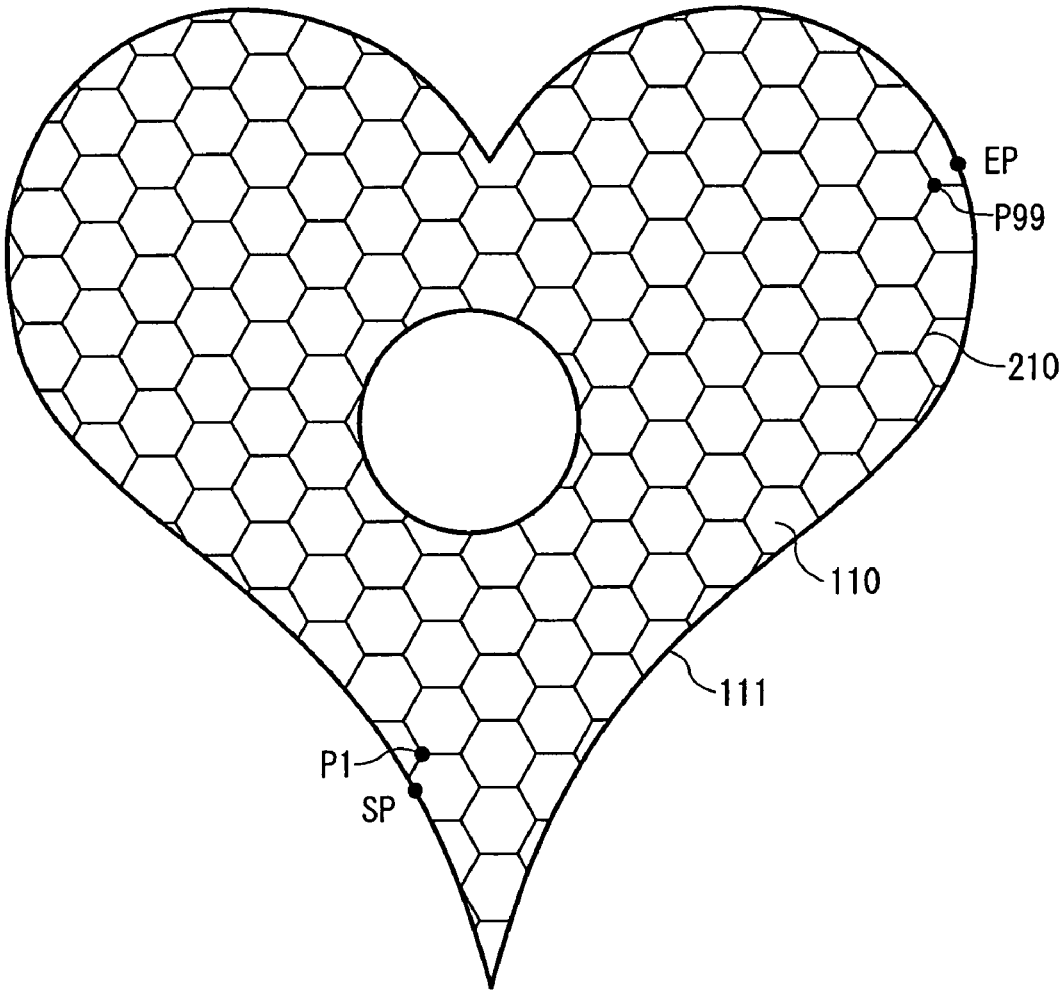
FIG. 10 is a schematic diagram of a profile line network, a stitch path starting point, and a stitch path ending point in the sewing area.

In an exemplary embodiment, as shown in FIG. 9, the X-coordinate axis may extend horizontally and its value may increase as it moves rightward along the coordinate axis, while the Y-coordinate axis may extend vertically and its value may increase as it moves downward along the coordinate axis. For example, a predetermined point of the first unit area may be disposed at predetermined coordinates, for example, origin (0, 0) of the coordinate system. In the example shown in FIG. 9, one vertex of the regular hexagon may be disposed at the origin (0, 0). In the present exemplary embodiment, following this disposed regular hexagon, other regular hexagons may continuously be arranged without a gap. Two profile lines each representing one side of the two neighboring unit areas (regular hexagons), which may be in contact with each other, may be recognized as one profile line. Then, only the profile lines existing in the sewing area 110 may be extracted as a profile line network 210 as shown in FIG. 10. Each side of the profile line of the regular hexagon, which is a unit area, is hereinafter referred to as a "side line segment". Also, a point which is a vertex of one regular hexagon, at which vertexes of three hexagons overlap, and at which endpoints of three side line segments overlap is hereinafter referred to as a "branch point". Further, the three side line segments of which one of the endpoints overlap at a branch point are hereinafter referred to as "peripheral side line segments" of the branch point, the three regular hexagons that share this branch point as their vertexes are hereinafter referred to as "peripheral regular hexagons", and the respective three endpoints of the three peripheral side line segments, which are at the other end of the side line segment from this branch point, are hereinafter referred to as "peripheral branch points".

Information that distinguish all the regular hexagons disposed in the sewing area 110 and the coordinates of the vertexes (branch points) of the regular hexagons may be stored as the information of the profile line network 210 in the profile line network storage area 1204 in the RAM 12.

Further, for creation of the profile line network 210, if there is no regular hexagon in the created profile line network 210, a stitch path may not be created. In such a case, the value stored in the reference distance storage area 1201 may be subtracted by a predetermined numeral (for example, 0.5 mm), to create a new profile line network 210. If, as a result, the value stored in the reference distance storage area 1201 becomes smaller than a predetermined threshold value (for example, 2 mm), even if a well-balanced stitch path is created, actual sewing may become difficult with the embroidery sewing machine 3. Therefore, in such a case, the CPU 11 may determine that it is impossible to form a stippling stitch in this sewing area and so may display an error message and end the processing.

After the profile line network 210 is created (S3), the stitch path starting point P1 and the stitch path ending point P99 may be determined on the profile line network 210 (S4). For example, a branch point closest to the starting point SP, which may have been specified by the user and stored in the starting point storage area 1205, may be set as the stitch path starting point P1 and stored in the stitch path storage area 1207. Similarly, a branch point closest to the ending point EP, which may have been specified by the user and stored in the ending point storage area 1206, may be set as the stitch path ending point P99 and stored in the stitch path storage area 1207 as the next point to the stitch path starting point P1.

Subsequently, an initial stitch path 310 may be created on the profile line network 210 (S5). Having the stitch path starting point P1 as a starting point, a side line segment located in a first predetermined direction (clockwise direction along the outer periphery of the sewing area in the present embodiment) may be determined as the initial stitch path 310. Then, focusing on the last branch point on the initial stitch path being created, a side line segment in a second predetermined direction (clockwise direction along the profile line of the regular hexagon to which the last branch point of the initial stitch path being created belongs in the present embodiment) may be traced, to determine the next branch point on the initial stitch path. The line segments obtained by continuously connecting the branch points on the initial stitch path may be determined as the initial stitch path 310. When the last branch point on the initial stitch path comes to the stitch path ending point P99, the creation of the initial stitch path 310 may be terminated. As a result of such a processing, the initial stitch path 310 may extend on the side line segments, which may be located closer to the outer periphery of the sewing area 110 in the clockwise direction.

Figure 11:
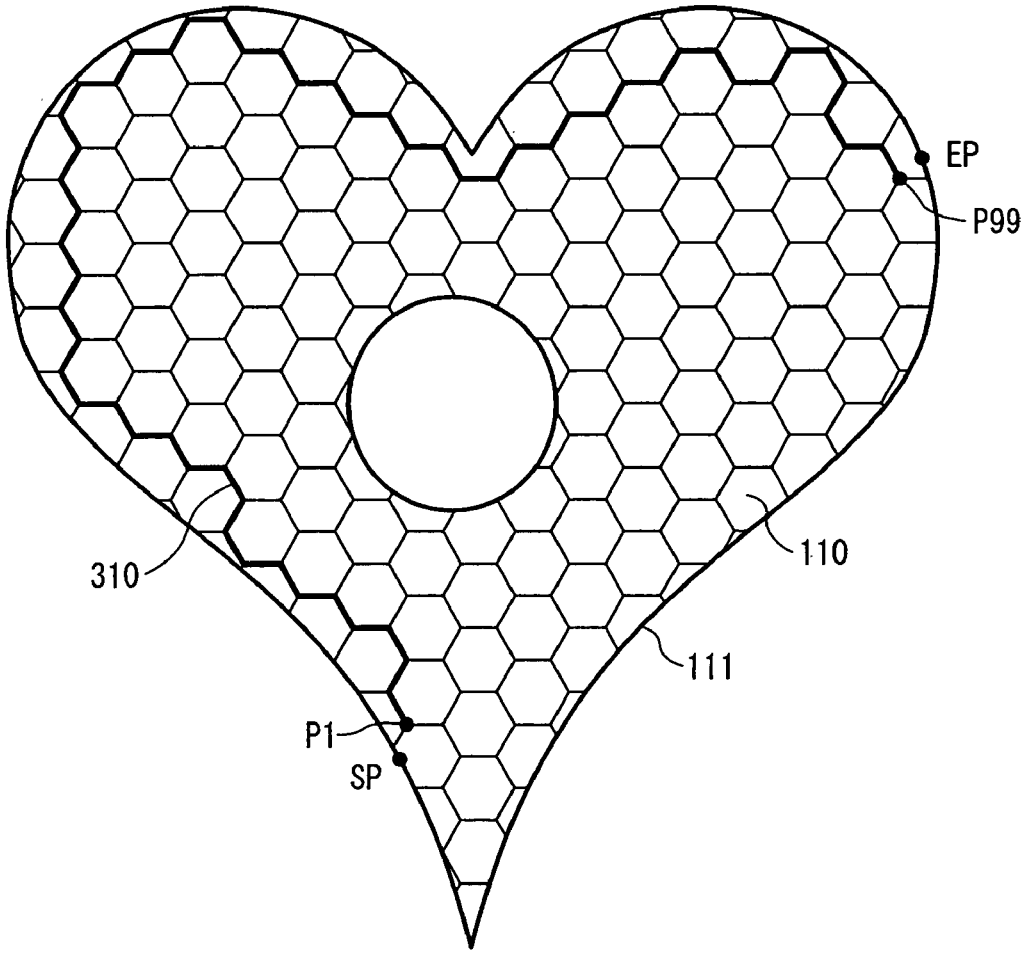
FIG. 11 is a schematic diagram of an initial stitch path created on the profile line network.

For example, in the case of the profile line network 210, stitch path starting point P1, and stitch path ending point P99 that may be disposed in the sewing area 110 as shown in FIG. 10, the initial stitch path 310 as shown in FIG. 11 may be created. A specific method of creating the initial stitch path 310 will be described in detail later with reference to FIGS. 15-24. Information that indicates the initial stitch path 310 may be stored in the stitch path storage area 1207. For example, coordinates of the branch points, which may be traced from the stitch path starting point P1 to the stitch path ending point P99, may be stored in order.

If the number of the branch points on the initial stitch path 310 is less than six (which is the number of the vertexes of a hexagon), a well-balanced stitch path is difficult to create. To avoid this situation, the value stored in the reference distance storage area 1201 may be subtracted by a predetermined numeral (for example, 0.5 mm). Then, a new profile line network 210 may be created (S3), new stitch path starting point and stitch path ending point may be determined (S4), and a new initial stitch path 310 may be created (S5). If the value stored in the reference distance storage area 1201 becomes smaller than a predetermined threshold value (for example, 2 mm), even if a well-balanced sewing path is created, it may become difficult to sew the stitches with the embroidery sewing machine 3. Therefore, in such a case, the CPU 11 may determine that it is difficult to form a stippling stitch in this sewing area and may end the processing after displaying an error message.

Figure 12:
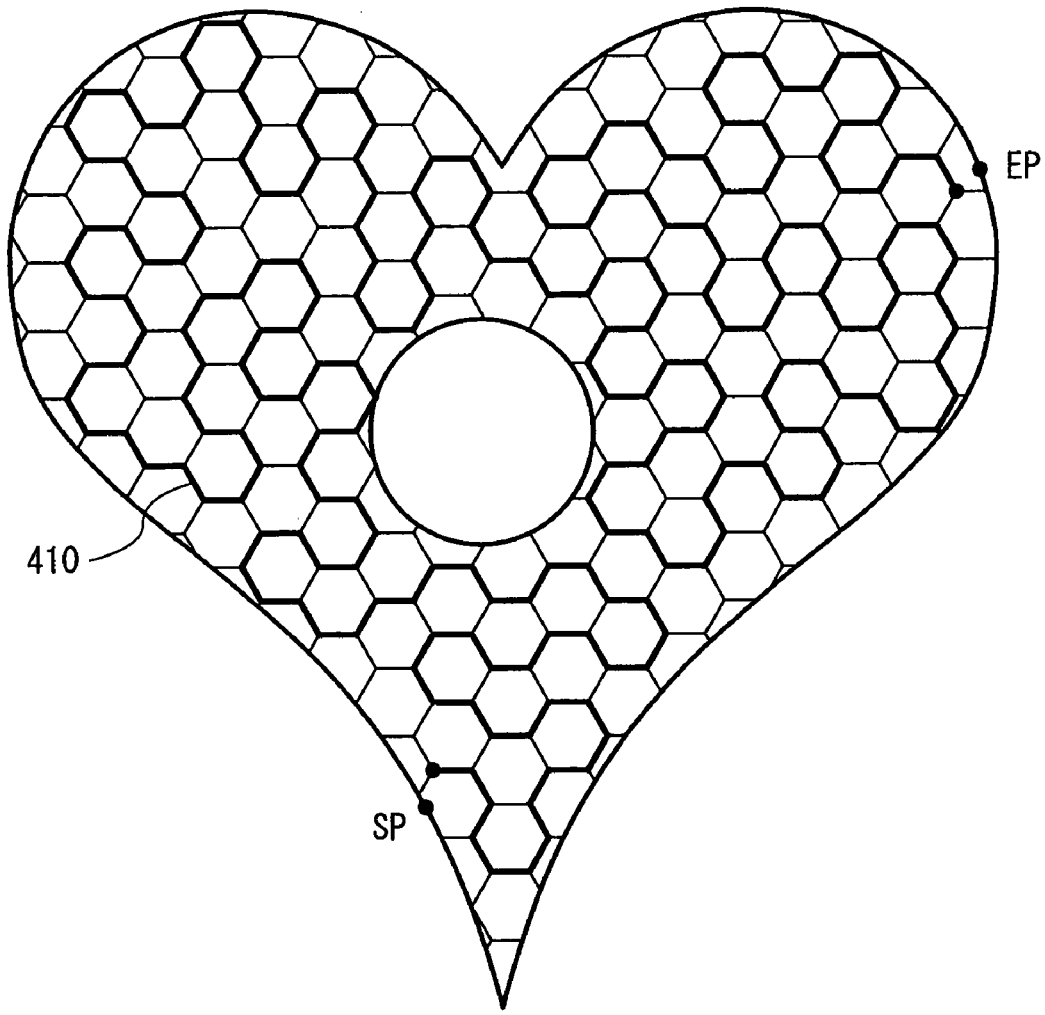
FIG. 12 is a schematic diagram of a stitch path created by moving the initial stitch path.

After the initial stitch path 310 is created (S5), movement processing may be performed (see S6 and FIG. 7). In the movement processing, the initial stitch path 310 on the profile line network 210 may be moved in such a manner that the stitch path is arranged evenly in the sewing area 110. The movement processing will be described in detail later with reference to FIGS. 7 and 25-31. For example, if the movement processing is performed on the initial stitch path 310 as shown in FIG. 11, to evenly dispose the stitch path in the sewing area 110, a stitch path 410 that is evenly arranged in the sewing area 110 as shown in FIG. 12 may be obtained.

After the stitch path 410 is evenly arranged in the sewing area 110 (S6), special processing may be performed (S7). The special processing may be performed to move the stitch path if there is a pointed portion or a tapered end portion in the sewing area 110. This will be described in detail later with reference to FIGS. 32-34.

Figure 13:
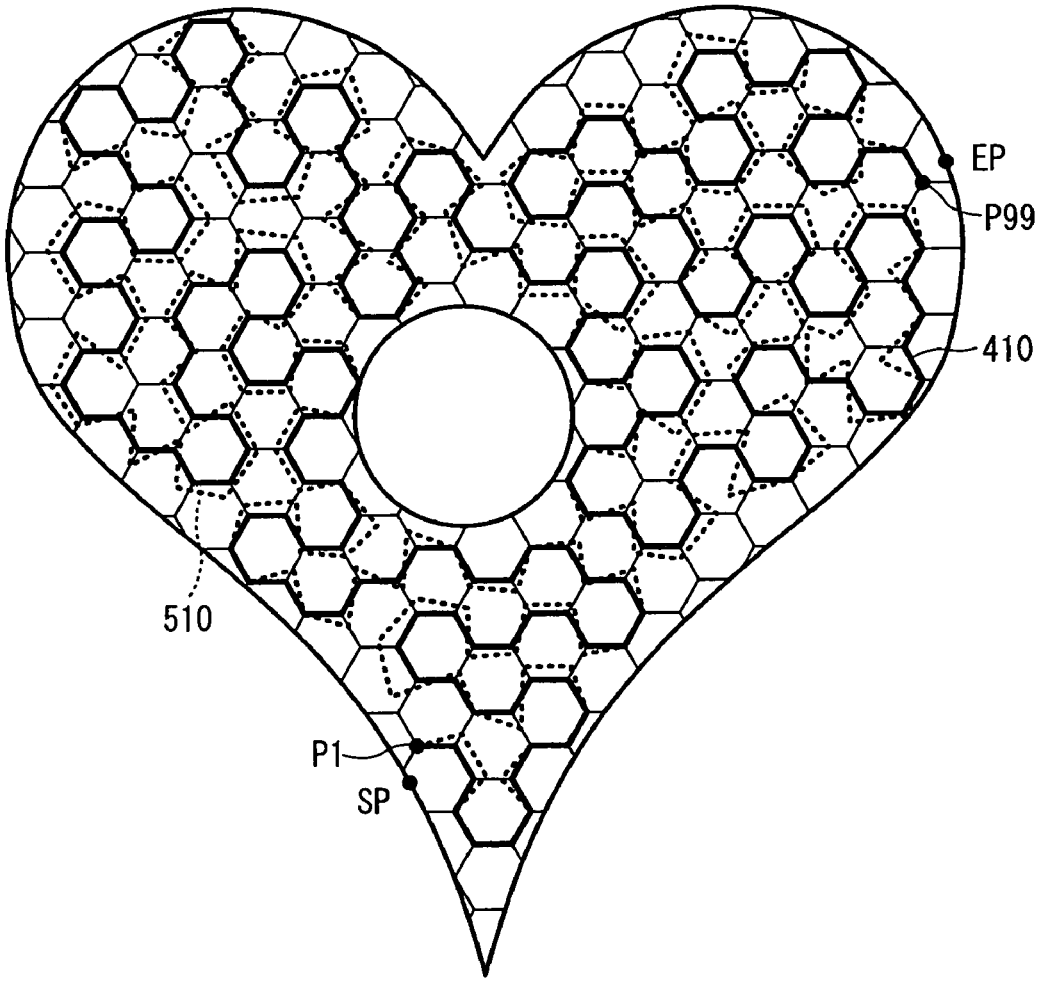
FIG. 13 is a schematic diagram of a transformed stitch path obtained by transforming the stitch path.

After the special processing (S7), transformation processing of the stitch path 410 is performed (S8). In the transformation processing, the coordinates of the branch points on the stitch path 410 may be moved, thereby creating a transformed stitch path 510 as shown in FIG. 13. By moving the branch points the curvatures of the curved stitch path may become uneven. As a result, the stitch path may become a non-uniform path, creating a well-balanced appearance. A path formed by a dotted line shown in FIG. 13 may be the transformed stitch path 510. A method for moving the coordinates of the branch points will be described in detail later with reference to FIGS. 35-37.

Figure 14:
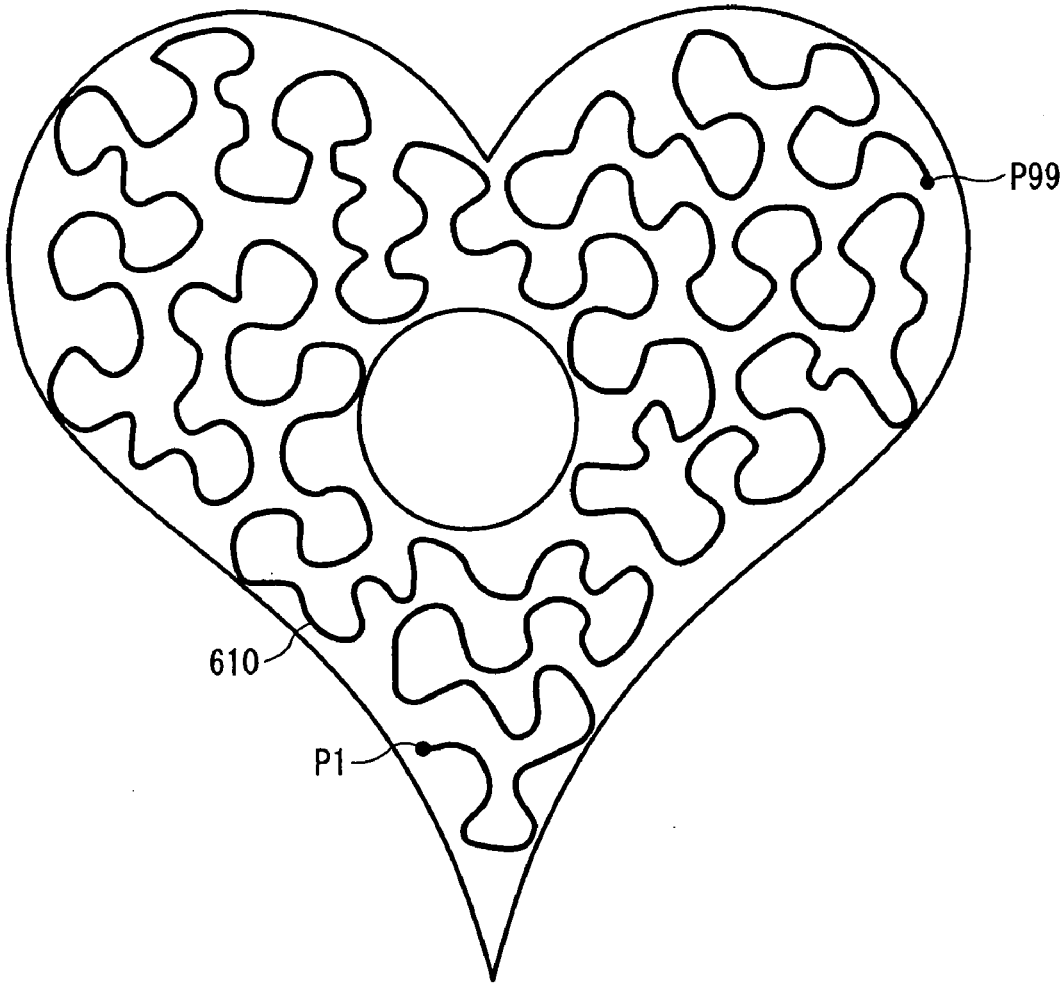
FIG. 14 is a schematic diagram of a path curve obtained by changing the transformed stitch path into a Bezier curve.
Figure 38:
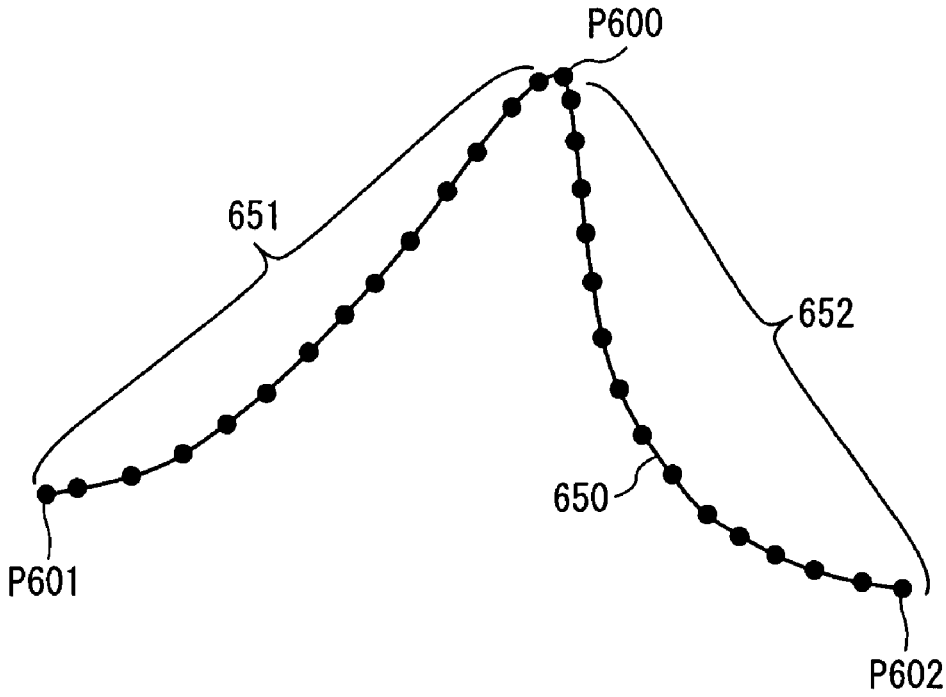
FIG. 38 is an explanatory diagram of a curve path.

Subsequently, a transformed stitch path 510 may be changed into a Bezier curve to create, for example, a curve path 610 shown in FIG. 14 and the information of the curve path 610 may be stored in the curve storage area 1208 (S9). As shown in FIG. 38, the curve path 610 may be represented by many points disposed densely on the curve. The coordinates of the points may be stored in the curve storage area 1208 sequentially from the stitch path starting point P1 to the stitch path ending point P99. Then, stitch creation processing may be performed (S10). In the stitch creation processing, needle drop points may be determined on the curve path 610 based on the stitch length stored in the stitch length storage area 1202 and may be stored in the stitch information storage area 1209. In the sewing data creation apparatus 1, the coordinates of the needle drop points may be determined in such a manner as to provide an even stitch length, that is, an even distance between the needle drop points. A method for determining the coordinates of the needle drop points will be described in detail later with reference to FIGS. 38-39. Then, sewing data which may be used in the embroidery sewing machine 3 may be created based on the information of the needle drop points stored in the stitch information storage area 1209 (S11), and the main processing may be terminated.

In such a manner, the initial stitch path 310 may be created on the profile line network 210 disposed in the sewing area 110 (S5), the initial stitch path 310 may be moved in such a manner that the stitch path may be evenly arranged in the sewing area 110, thereby creating the stitch path 410 (S6). Further, the stitch path 410 is transformed to create the transformed stitch path 510 (S8) and the transformed stitch path 510 may further be changed into a Bezier curve to create the curve path 610 (S9), thereby determining a path for a stippling stitch. Based on thus created sewing data, the embroidery sewing machine 3 may be driven to sew the stippling stitch onto the work cloth held by the embroidery frame 31.

Figure 15:
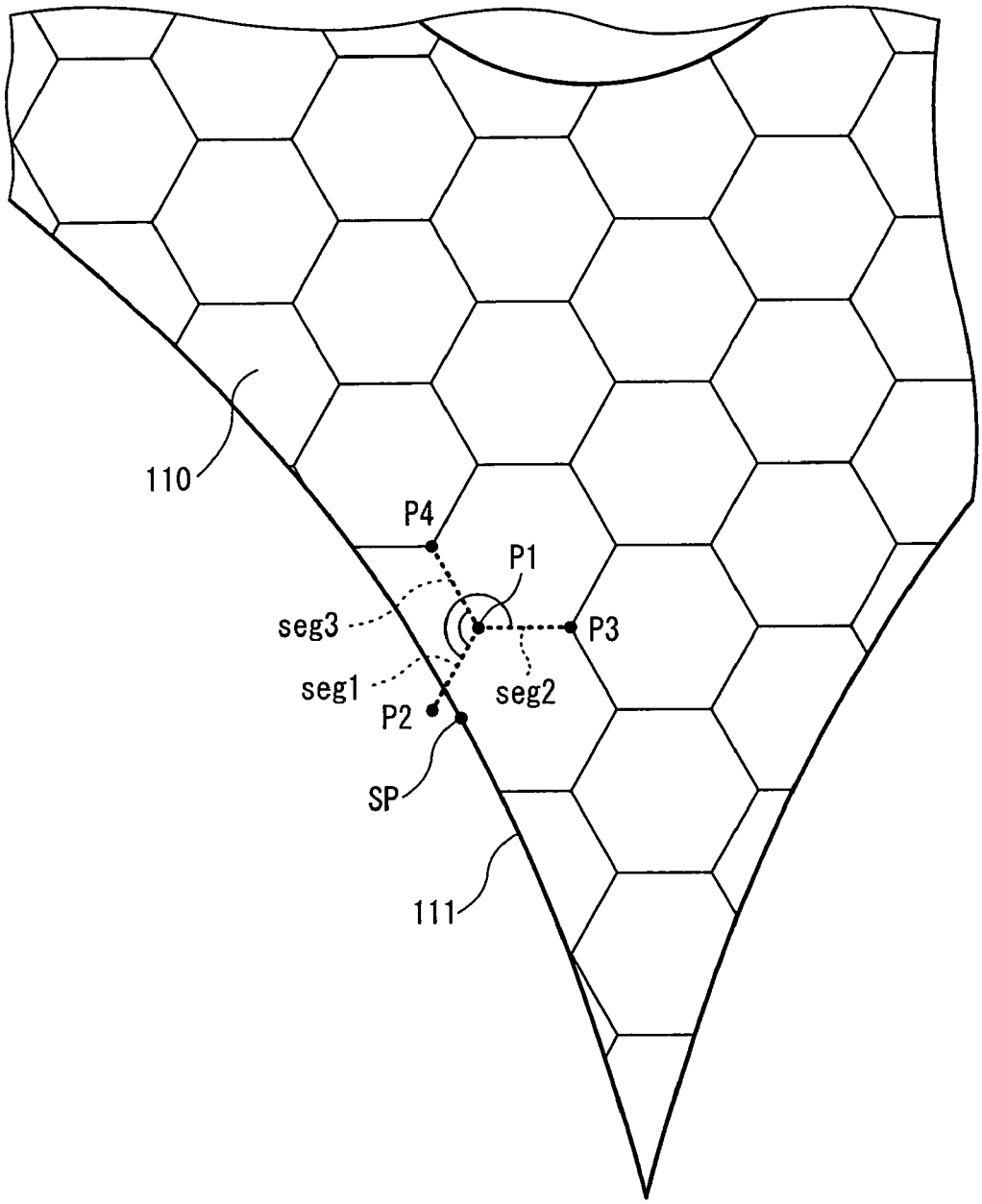
FIG. 15 is an explanatory diagram of a determination of a branch point that follows a stitch path starting point.

Next, a method for creating the initial stitch path 310 will be described in detail below with reference to FIGS. 15-20. As shown in FIG. 15, at the stitch path starting point P1, peripheral side line segments of the branch point P1, for example, seg1, seg2, and seg3 that share the branch point P1 as one of their endpoints may be specified as candidates for the initial stitch path 310. The endpoint of the side line segment seg1 other than the branch point P1 may be a branch point P2, the endpoint of the side line segment seg2 other than the branch point P1 may be a branch point P3, and the endpoint of side line segment seg3 other than the branch point P1 may be a branch point P4. The branch points P2, P3, and P4 may be the peripheral branch points of the branch point P1.

Figure 16:
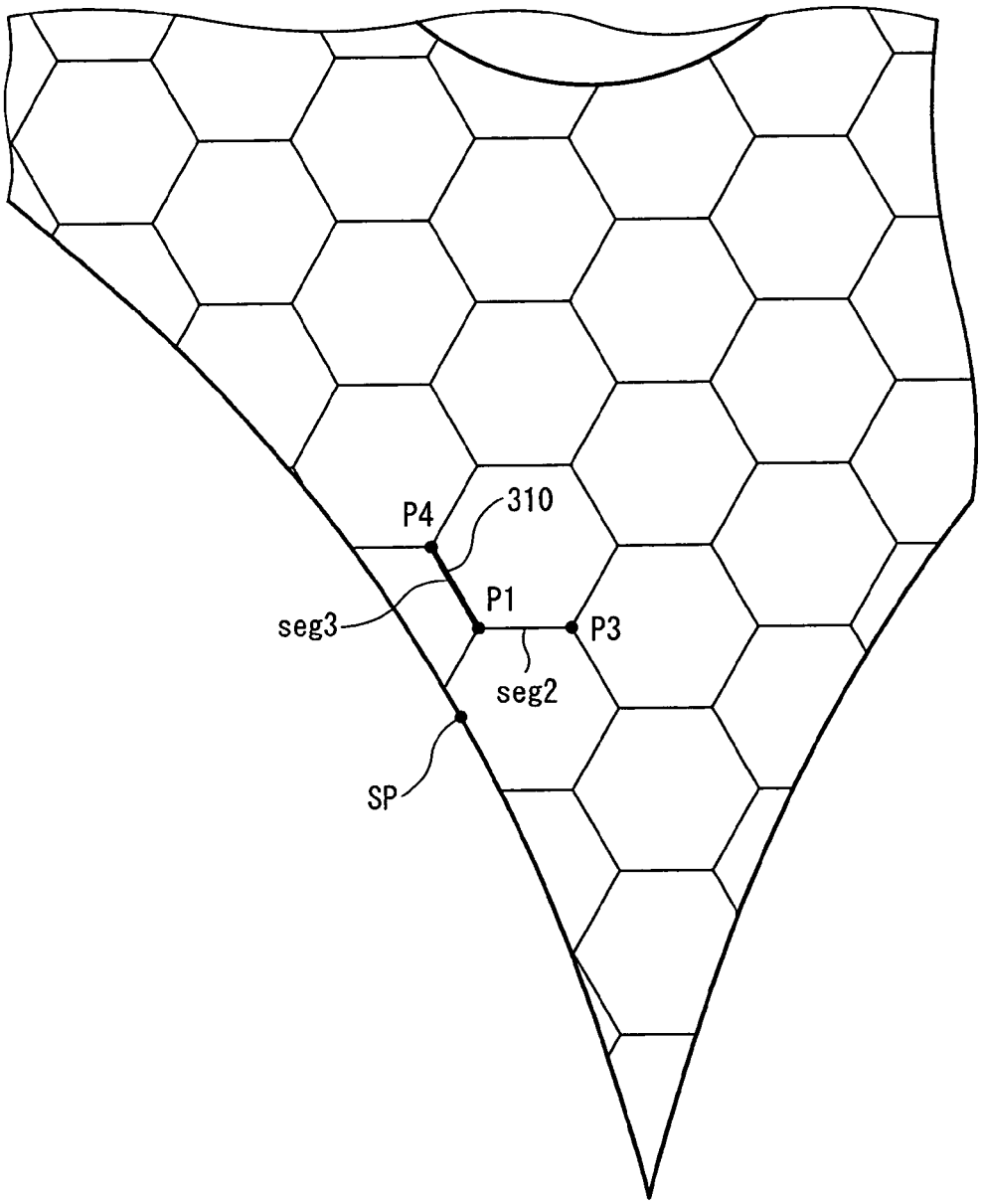
FIG. 16 is an explanatory diagram of a state where one side line segment is determined as a stitch path.

In an exemplary embodiment, the initial stitch path 310 may be formed by tracing the side line segment closer to the outer profile line of the sewing area 110 leftward from the stitch path starting point P1 as a starting point up to the stitch path ending point P99. In other words, the side line segment closer to the outer periphery of the sewing area 110 may be successively traced clockwise along the outer periphery of the sewing area 110. For example, first, a line segment intersected by the outer profile line 111 of the sewing area 110 may be searched for from among the peripheral side line segments of the stitch path starting point P1, for example, seg1, seg2, and seg3. In an example shown in FIG. 15, the side line segment seg1 may be obtained. Then, angles between the side line segment seg1 and each of side line segments seg2 and seg3 may be calculated. These angles may be calculated angles from the side line segment seg1 in the clockwise direction. One of the two side line segments with a smaller angle calculated may be determined to be closer to the outer periphery in the clockwise direction. The branch point of the side line segment other than the stitch path staring point P1 may be determined as a new branch point on the initial stitch path. In the example shown in FIG. 15, the side line segment seg3 may be determined as being closer to the outer periphery in the clockwise direction, and the branch point P4 may be selected as a new branch point on the initial stitch path. Therefore, the coordinates of the branch point P4 may be inserted between the stitch path starting point P1 and the stitch path ending point P99 and may be stored in the stitch path storage area 1207. As a result, the initial stitch path 310 may be extended from the branch point P1 to the branch point P4. In FIG. 16, the side line segment seg3 shown in bold line represents the initial stitch path 310 at this stage.

Next, the direction in which the initial stitch path is to be extended from the branch point P4 will be described below with reference to FIG. 17. The peripheral branch points of the branch point P4 may be branch points P1, P5, and P6. Out of these three points, the branch point P1 may serve as an origin based on which the branch point P4 was set on the initial stitch path. Therefore, the branch point P1 may be excluded from candidates for a new point on the initial stitch path. Instead, a branch point located to the left of the branch point P4 as viewed from the branch point P1 may first be determined as a candidate for a new point on the initial stitch path. That is, the side line segment seg4 diverging to the left from the branch point P4 as viewed from the branch point P1 may be determined as a candidate for an initial stitch path. A branch point positioned to the left of branch P4 as viewed from the branch point P1 may be selected by comparing the coordinates of branch P1 and those of the branch point P4.

FIG. 21 shows various cases of determining the branch points on the left side. In FIG. 21, a bold-line arrow in a schematic diagram field may indicate a side line segment already determined as the initial stitch path and a dotted-line arrow may indicate a side line segment to be newly selected as the initial stitch path. In the schematic diagrams of FIG. 21, the x-axis extends rightward and the y-axis extends downward. For example, in the case of the upper left schematic diagram in an explanatory table 800, a side line segment seg801, which may have already been determined as the initial stitch path, may have its x-coordinate increasing and its y-coordinate decreasing in a direction from the starting point to the ending point of the initial stitch path. In such a case, the x-coordinate should be the same as that of the target branch point P801 and the y-coordinate should be smaller than that of the focus branch point P801. Therefore, a branch point P802 may be selected as a candidate for a new point on the initial stitch path.

Figure 17:
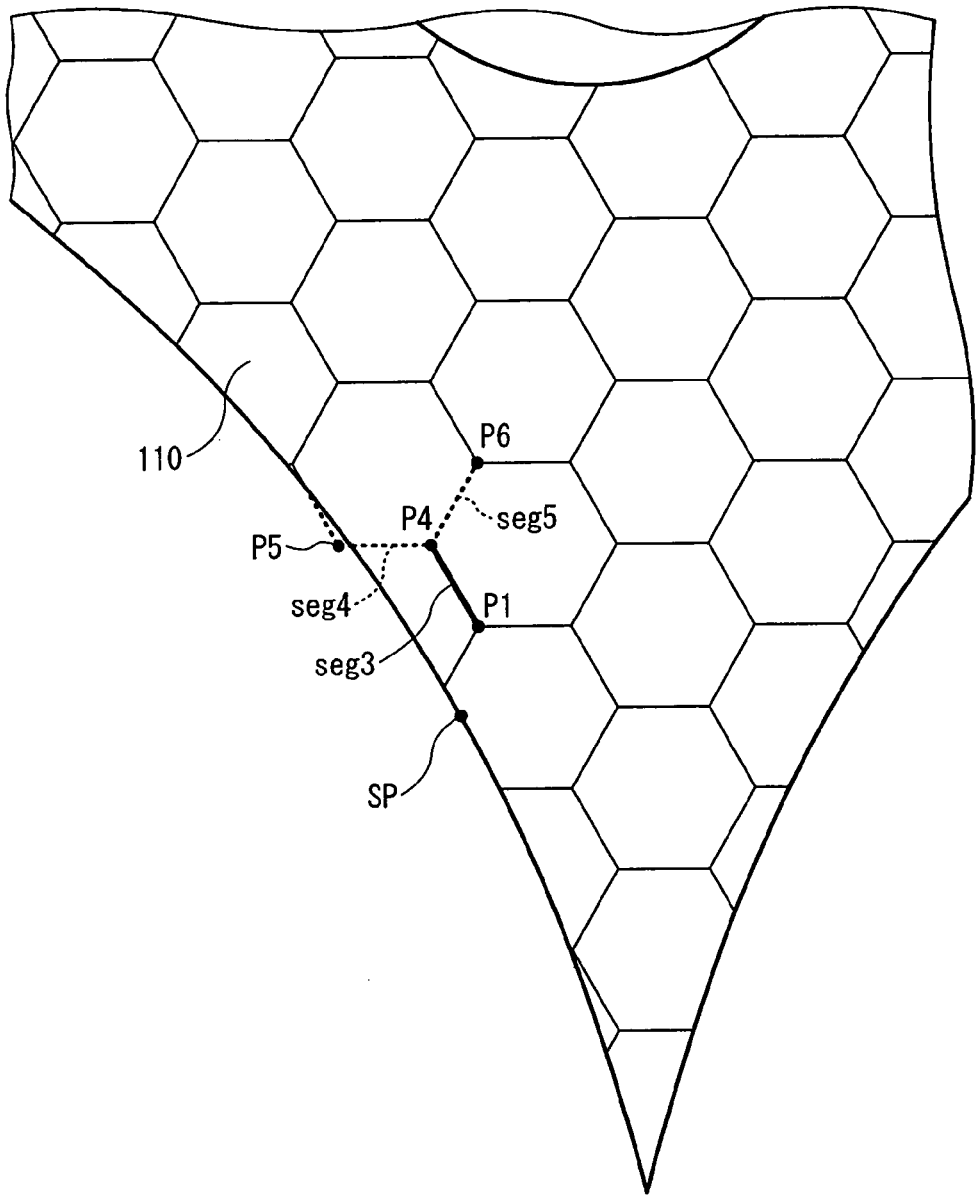
FIG. 17 is an explanatory diagram of a process of determining a next branch point following the state of FIG. 16.

The example shown in FIG. 17 corresponds to the lower right schematic diagram in the explanatory table 800 shown in FIG. 21. Accordingly, a branch point on the left side of the branch point P4 may be determined as the branch point P5.

Then, the coordinates of the branch point P5 are calculated and it may be determined whether the coordinates are stored in the stitch path storage area 1207. That is, it may be determined whether the line segment seg4 connecting the branch points P4 and P5 has already been determined as the stitch path. However, the coordinates of the branch point P5 may not be stored in the stitch path storage area 1207. Therefore, subsequently, it may be determined whether the coordinates are stored in the profile line network storage area 1204. However, as shown in FIG. 17, the branch point P5 may be positioned outside the sewing area 110, so that its coordinates are not stored in the profile line network storage area 1204. Accordingly, the branch point P5 may be excluded from the candidates for the next point on the initial stitch path.

Figure 18:
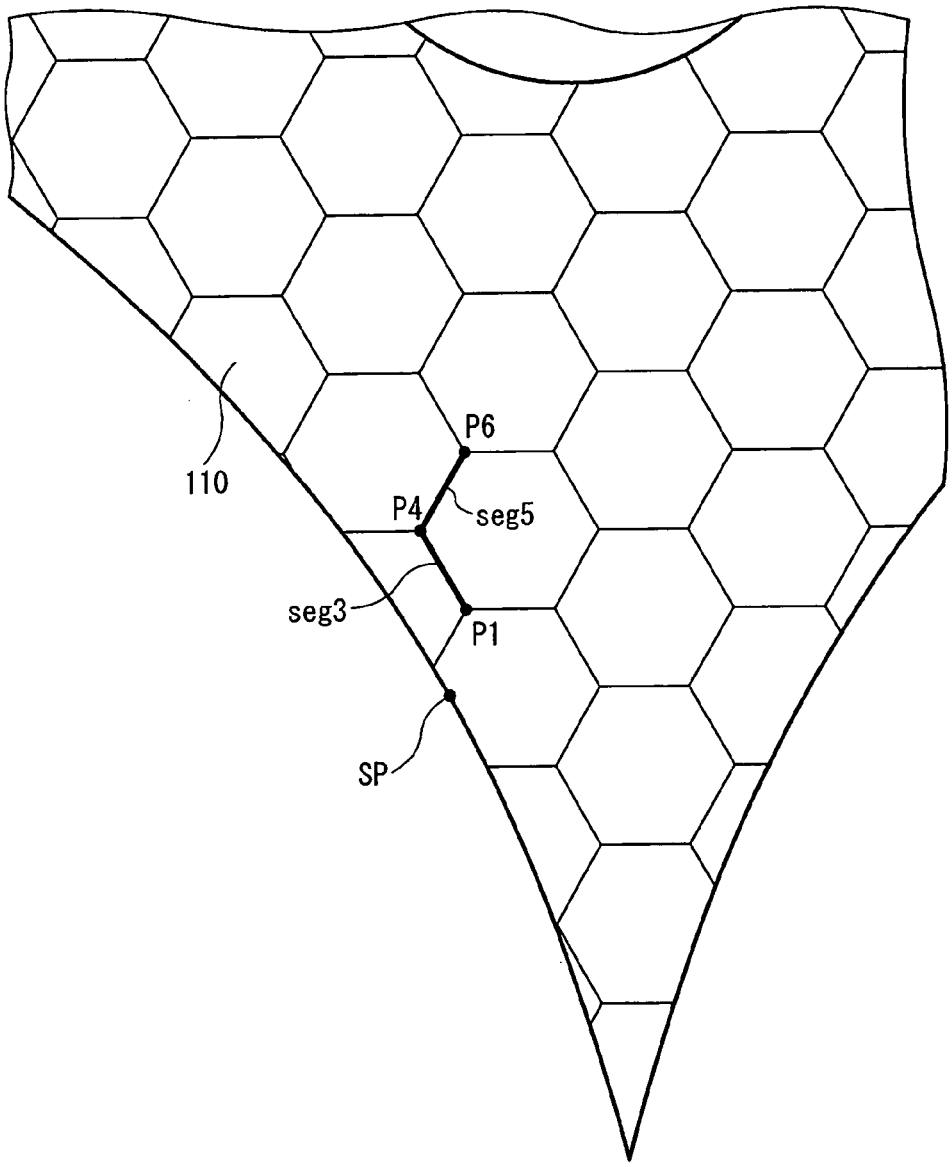
FIG. 18 is an explanatory diagram of a state where the next branch point following the state of FIG. 16.

Subsequently, the coordinates of the branch point P6 on the right side may be calculated and it may be determined whether its coordinates are stored in the stitch path storage area 1207. At the stage of FIG. 17, the coordinates of the branch point P6 may not yet be stored in the stitch path storage area 1207. Then, it may be determined whether its coordinates are stored in the profile line network storage area 1204. The coordinates of the branch point P6 may be inside the sewing area 110 and stored in the profile line network storage area 1204. Therefore, the side line segment seg5 connecting the branch points P4 and P6 may be determined as a next point on the initial stitch path, and the coordinates of the branch point P6 may be inserted between the branch point P4 and the stitch path ending point P99 and stored in the stitch path storage area 1207. As a result, as shown in FIG. 18, the initial stitch path may be traced from the branch point P1 to the branch points P4 then to P6.

Figure 19:
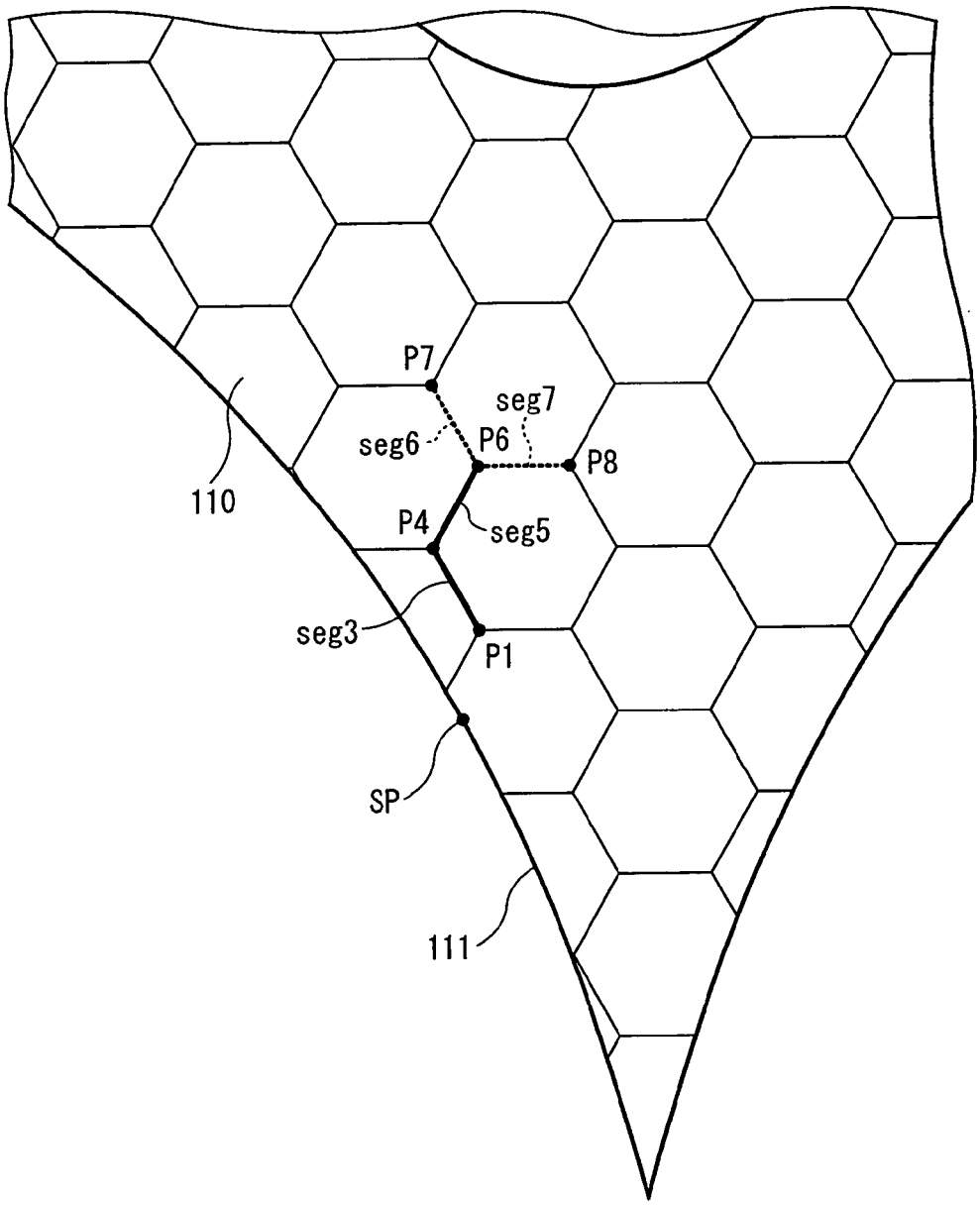
FIG. 19 is an explanatory diagram of a process of determining a next branch point following the state of FIG. 18.
Figure 20:
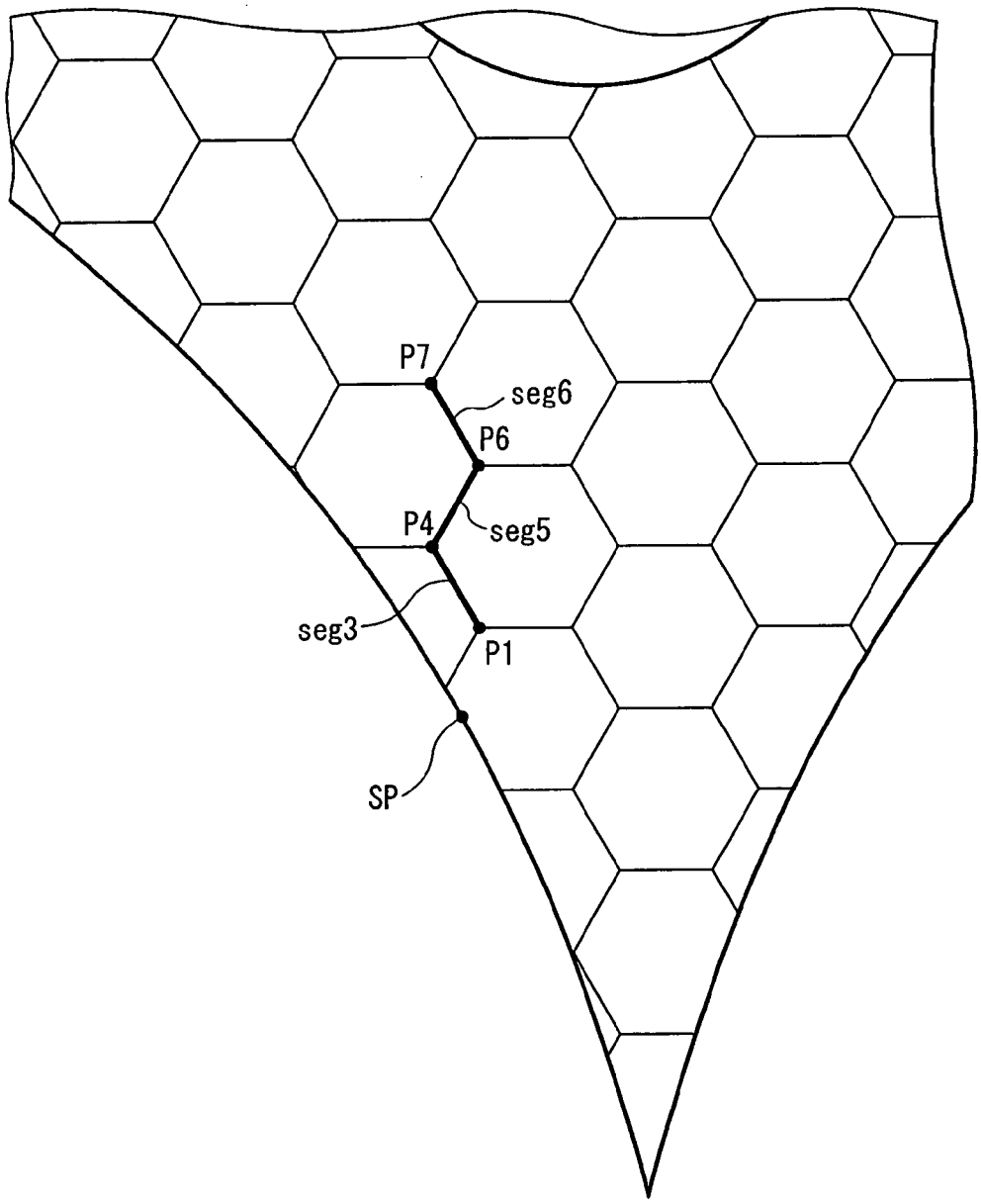
FIG. 20 is an explanatory diagram of a state where the next branch point is determined following the state of FIG. 18.

Next, as shown in FIG. 19, focusing on the branch point P6, the next branch point on the initial stitch path may be determined based on the three peripheral branch points of the branch point P6, that is, the branch points P7, P8, and P4. Among the three branch points, the branch point P4 may serve as the origin and so that the branch point P4 may be excluded from the candidates. Also, the side line segment seg5 may slope to the upper right, and when the branch points P4 and P6 are compared, the x-coordinate may be increased, and the y-coordinate may be decreased. Accordingly, as shown in the explanatory table 800 of FIG. 21, a side line segment to be selected should have its x-coordinate and y-coordinate decreasing. From the explanatory table 800, the branch point P7 may be determined to be on the left side of the branch point P6 as viewed from the branch point P4. Accordingly, the branch point P7 may be determined as the first candidate for the next point on the initial stitch path and it may be determined whether it may be selected as the next point on the initial stitch path. In the example, the branch point P7 has not yet been selected as a point on the initial stitch path and so it may not be stored in the stitch path storage area 1207. In addition, the branch point P7 may be in the sewing area 110 and this may be stored in the profile line network storage area 1204. Therefore, the branch point P7 may be determined as the next point on the initial stitch path and the side line segment seg6 connecting the branch points P6 and P7 may be determined as the initial stitch path. The coordinates of the branch point P7 may be inserted between the branch point P6 and the stitch path ending point P99 stored in the stitch path storage area 1207. As a result, as shown in FIG. 20, the initial stitch path may be traced from the branch point P1 to the branch points P4, P6, and then to P7.

In such a manner, the next branch point of the newly determined branch may be sequentially determined, thereby creating the initial stitch path 310 as shown in FIG. 11.

Figure 22:
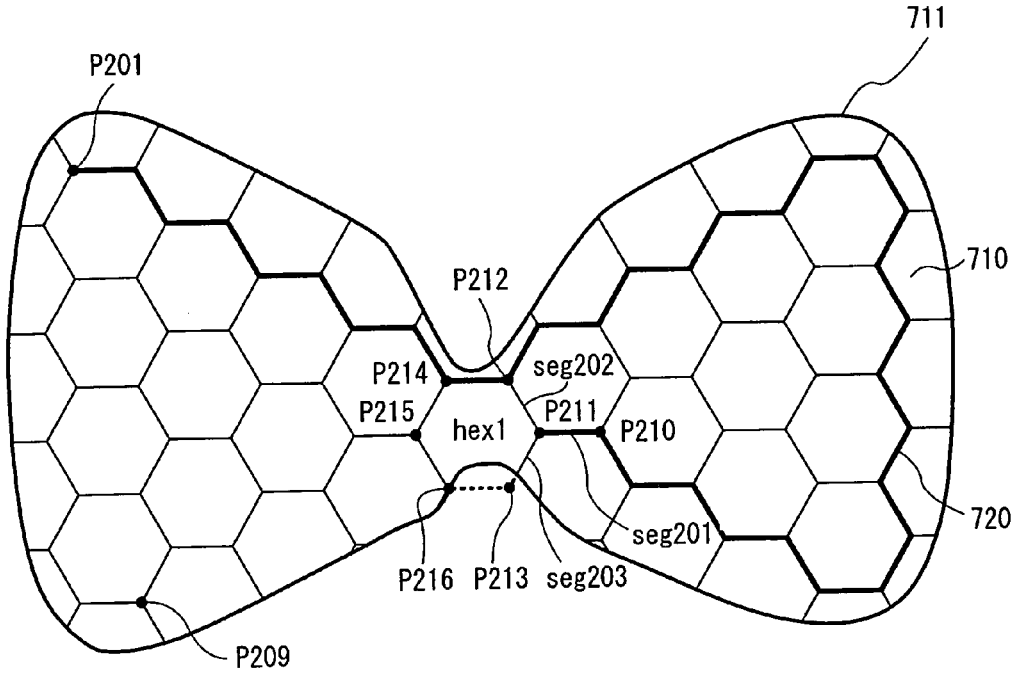
FIG. 22 is an explanatory diagram of a state where an initial stitch path has been created immediately before a narrowed portion.
Figure 23:
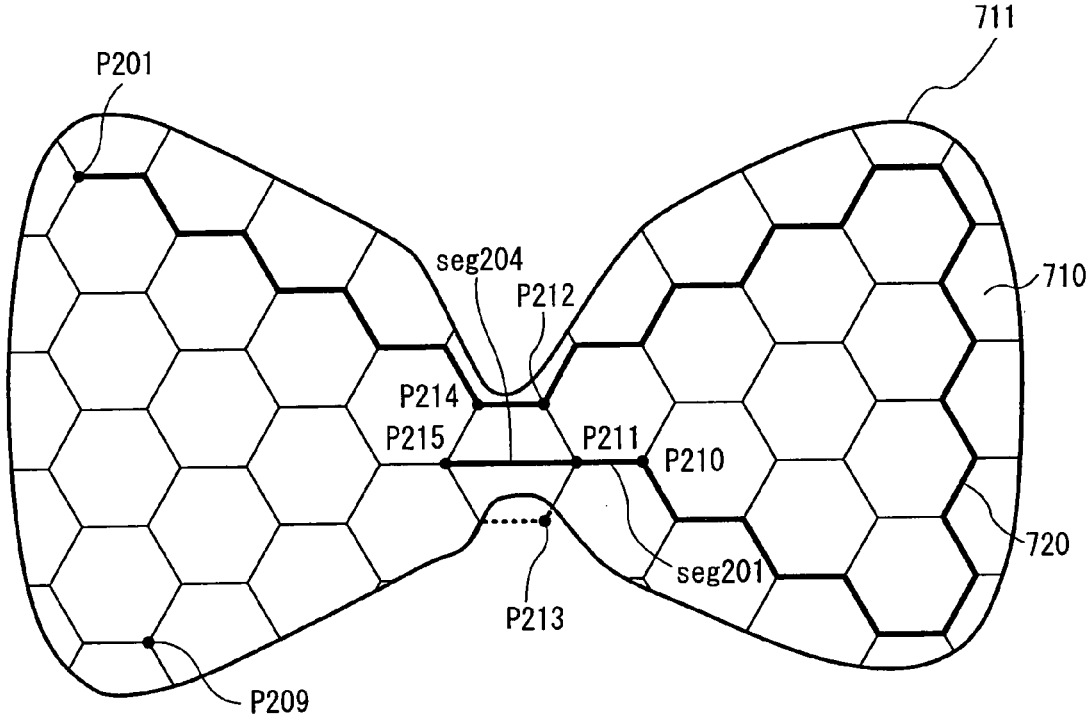
FIG. 23 is an explanatory diagram of a state after the initial stitch path has been created at the narrowed portion.
Figure 24:
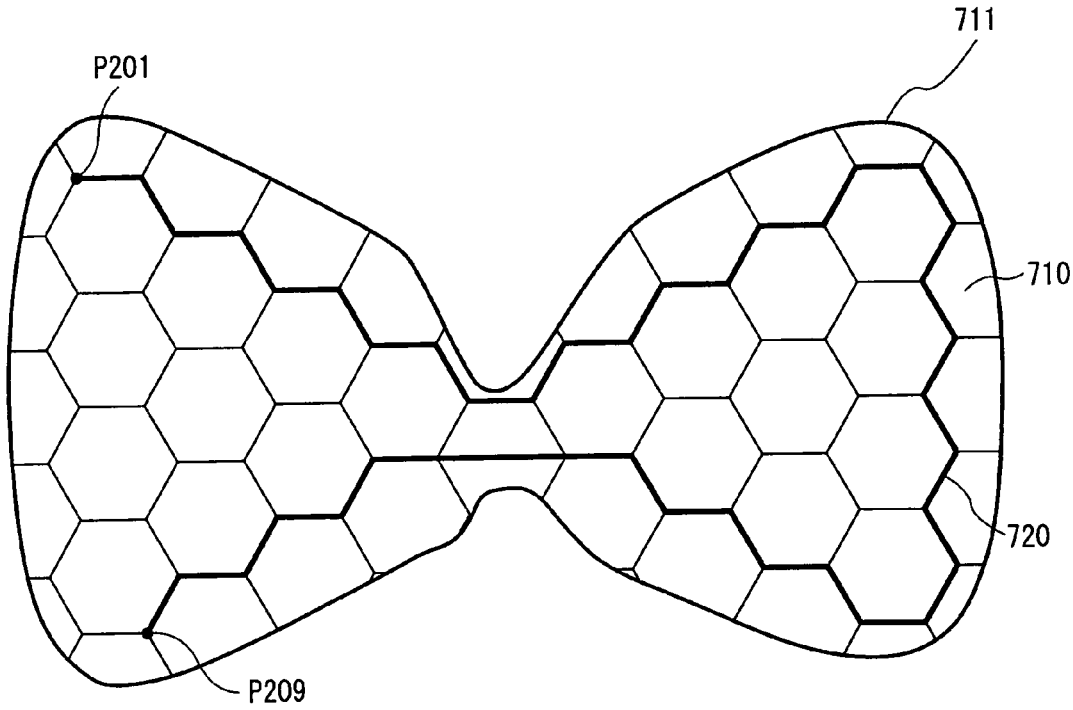
FIG. 24 is a schematic diagram of a state where the whole initial stitch path has been created in a sewing area.

The following will describe special processing in creation of the initial stitch path 310 with reference to FIGS. 22-24. The special processing may be performed in a process of creating the initial stitch path in a sewing area such as the sewing area 710 defined by a profile line 711 having a narrowed portion as shown in FIG. 22. The narrowed portion herein refers to a portion where the distance between two parts of the profile line facing each other may be smaller than the length of the unit area so that only one or less side line segment of the profile line network exists.

As shown in FIG. 22, an initial stitch path 720 may have been created from a stitch path starting point P201 to a branch point P211 along the outer profile line of the sewing area 710 in the clockwise direction. In this case, a problem may occur when a next branch point following the branch point P211 is determined on the initial stitch path 720. The branch point P211 may have the following peripheral branch points P210, P212, and P213. The branch point P210 may be excluded from the candidates because it served as an origin when determining the branch point P211 as a point on the initial stitch path. Accordingly, the branch point P213 may be determined as a first candidate for the next point on the initial stitch path. However, in this example, the branch point P213 is outside the sewing area 710 and thus not stored in the profile line network storage area 1204. Moreover, the next candidate branch point P212 may already be positioned on the initial stitch path 720 and stored in the stitch path storage area 1207. In this example, none of the three peripheral points of the branch point P211 satisfy the conditions for being a new point on the initial stitch path 720.

In such an example, two of the side line segments among seg201, seg202, and seg203 having the branch point P211 as the endpoint are selected, excluding one of the side line segments already determined as the initial stitch path 720. Focus is then made on a regular hexagon which has the previously selected two side line segments. In the example of FIG. 22, a regular hexagon hex1 has the side line segments seg202 and seg203, excluding the side line segment seg201. The regular hexagon hex1 may have six vertexes from the branch point P211 to branch points P213, P216, P215, P214, and P212 clockwise. Then, as shown in FIG. 23, a line segment seg204 that connects the branch point P211 and its facing vertex P215 may be created. Then, it may be determined whether the line segment seg204 intersects with the profile line 711 of the sewing area 710. As shown in FIG. 23, if the line segment seg204 and the profile line 711 do not intersect, the branch point P215 may be determined as a new point on the initial stitch path. Then, the coordinates of branch point P215 may be inserted between the branch point P211 and the stitch path ending point P209 and may be stored in the stitch path storage area 1207. Afterward, through ordinary processing, the initial stitch path 720 may be created up to the stitch path ending point P209 along such a path as shown in FIG. 24.

If the line segment seg204 and the profile line 711 intersect, the line segment seg204 that connects the branch points P215 and P211 may pass through outside the sewing area 710. In such a case, the branch points P215 and P211 should not be connected. Therefore, the initial stitch path 720 should not be extended any further and the stitch path ending point P209 should not be reached. In such a manner, there may be a case where none of the three peripheral branch points satisfies the conditions for being a new point on the initial stitch path 720. Additionally, when a regular hexagon has two side line segments out of the three peripheral side line segments of this branch point, excluded from the initial stitch path 720, a line segment connecting the facing vertexes may intersect with a profile line of a sewing area. In this case, a message may be displayed to notify the user that a stitch path is difficult to create and the processing may be terminated. Therefore, the user may change the sewing area, for example, subdivide the sewing area into right and left regions at the narrowed portion, and perform the main processing again.

Next, the operations of moving the initial stitch path 310 to thereby create the stitch path 410 evenly disposed in the sewing area 110 will be described in detail below with reference to the flowchart of FIG. 6 and FIGS. 25-28. In the movement processing shown in S6 of the main processing of FIG. 5, if the number of the side line segments that have been determined as the stitch path in a target regular hexagon is smaller than the number of the side line segments, which have not yet been determined as the stitch path, the side line segments that have been determined as the stitch path may be excluded from the stitch path. Also, the side line segments that have not yet been determined as the stitch path may be determined as the stitch path instead. That is, rather than changing the starting point and the ending point of the stitch path in the target regular hexagon, the stitch path may be moved on the profile line of the hexagon so that it has a longer distance.

For example, the initial stitch path 310 may be taken as an initial state, and the branch points on the stitch path may sequentially be traced from the stitch path starting point P1 to the stitch path ending point P99. It may then be determined whether the state corresponds to such a pattern (movement pattern) that the stitch path may be moved. If the state corresponds to a stitch path movement pattern, the stitch path may be moved. In an exemplary embodiment, various modes may be provided to define a probability of actually moving the stitch path, depending on the state of a branch point that corresponds to a movement pattern. In tracing the branch points from the stitch path starting point P1 to the stitch path ending point P99, the probability may then be determined in accordance with the corresponding mode. Thus, the stitch path may be moved at random, to result in the stitch path arranged in the sewing area 110 in a balanced manner.

In the following, first, the movement patterns will be described and then the modes will be described, with reference to FIGS. 25-28. Two patterns, that is, movement patterns A and B may be provided. The movement pattern A may represent a state in which a target regular hexagon has two side line segments, which have been made as the stitch path and four side line segments that may not have been made the stitch paths. The movement pattern B may represent a state in which a target regular hexagon has one side line segment, that may have been made as a stitch path and five side line segments that may not have been made as the stitch paths.

First, the movement pattern A will be described below. Focusing on one branch point, branch points may be traced counterclockwise. Branch points may be respective vertexes of a regular hexagon having the focused-on branch point (target point) as one of its vertexes. Then, it may be determined whether these branch points have their coordinates stored in the stitch path storage area 1207 and are thus already on the stitch path. If none of the first, second, and third vertexes is on the stitch path, while the fourth vertex is a point on the stitch path, this state may be determined to correspond to the movement pattern A. In other words, it is an example of a side line segment connecting the target point and the fifth vertex when counted counterclockwise and another side line segment connecting the fifth and fourth vertexes have already been determined as the stitch path.

If the movement pattern A applies, two side line segments may be determined as the stitch path. The two side line segments may be a side line segment connecting the target point and the fifth vertex and another side line segment connecting the fifth and fourth vertexes. Because the regular hexagon may be formed by six side line segments, none of the remaining four side line segments need to be determined to be the stitch path. Therefore, because the total length of the four side line segments may be longer than that of the two side line segments, the stitch path may be moved to the four side line segments. That is, the stitch path may be changed to the side line segments connecting, counterclockwise, the target point and the first vertex, the first and second vertexes, the second and third vertexes, and the third and fourth vertexes.

Figure 25:
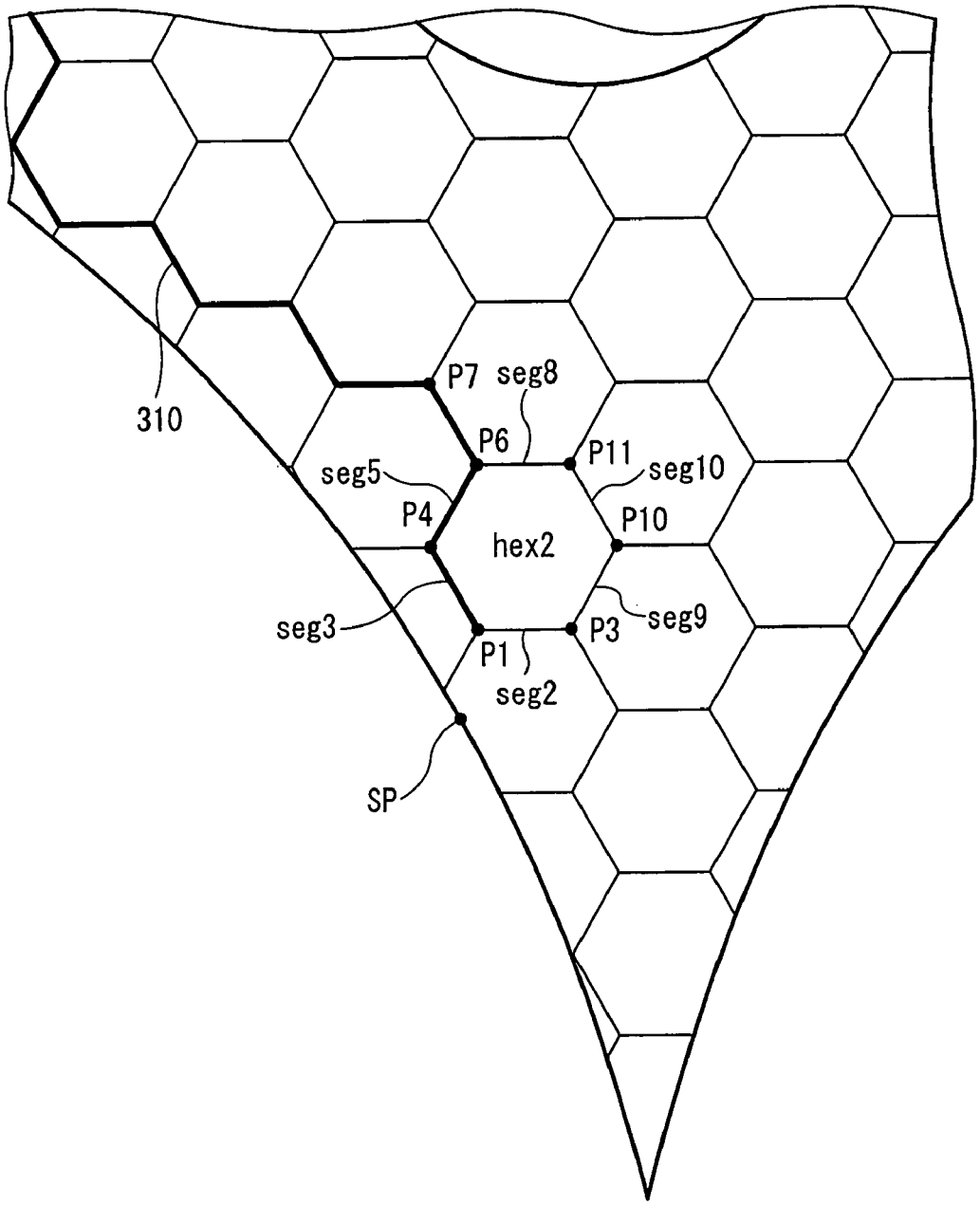
FIG. 25 is an explanatory diagram showing a case to which movement pattern A applies.

In the example shown in FIG. 25, the stitch path starting point P1 may be a target point and focus may be made on a regular hexagon hex2 having the vertexes of branch points P3, P10, P1, P6, and P4, and the branch points P3, P10, P11, P6, and P4 may be traced in this order in the regular hexagon hex2. In the regular hexagon hex2, two side line segments, for example, is, the side line segment seg3 connecting vertexes P1 and P4 and the side line segment seg5 connecting vertexes P4 and P6, may be the initial stitch path 310. For example, in the stitch path storage area 1207 may be stored the information of branch points P1, P4, P6, P7, in this order as the points on the stitch path. That is, none of the first, second, and third vertexes (P3, P10, and P11) may be on the stitch path, but the fourth vertex (P6) may be on the initial stitch path 310. Therefore, this state may be determined as corresponding to the movement pattern A.

Accordingly, the information of the branch point P4 (the fifth point as counted from the target point counterclockwise) may be deleted from the stitch path storage area 1207. Instead, the information of the branch point P3 (the first point as counted from the target point counterclockwise), P10 (the second point as counted from the target point counterclockwise), and P11 (the third point as counted from the target point counterclockwise) may be stored in the stitch path storage area 1207 where the information of the branch point P4 was previously stored. As a result, the information of the branch points P1, P3, P10, P11, P6, P7, . . . may be stored in the stitch path storage area 1207 in this order.

Figure 26:
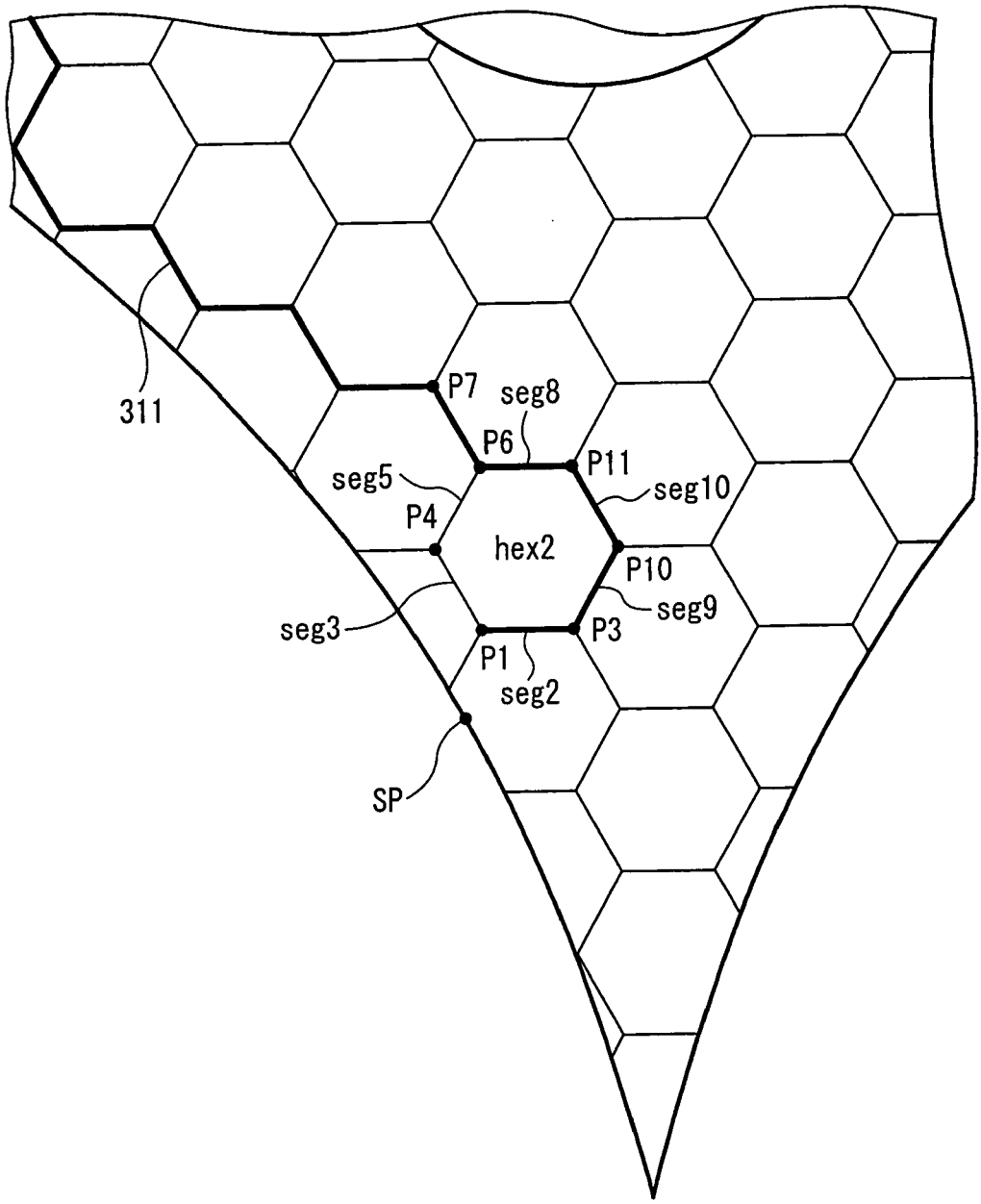
FIG. 26 is an explanatory diagram showing a stitch path obtained by moving a part of the initial stitch path of FIG. 25.

Consequently, as shown in FIG. 26, a side line segment seg2 connecting the target point P1 and the first vertex P3, a side line segment seg9 connecting the first vertex P3 and the second vertex P10, a side line segment seg10 connecting the second vertex P10 and the third vertex P11, and a side line segment seg8 connecting the third vertex P11 and the fourth vertex P6 may be included on the stitch path 311 after the movement. In this case, the fourth vertex P6 may be determined as the next target point.

Next, the movement pattern B will be described below. In this case also, focusing on one branch point as a target point, branch points may be traced counterclockwise, which branch points may be respective vertexes of a regular hexagon having the target point. Then, it may be determined whether those branch points have their coordinates stored in the stitch path storage area 1207 and are already on the stitch path. If none of the first, second, third, and fourth vertexes are on the stitch path, but the fifth vertex is on the stitch path, this state may be determined as corresponding to the movement pattern B. In other words, this may be a state where only one side line segment connecting the target point and the fifth vertex has been determined as the stitch path in the target regular hexagon.

If the movement pattern B applies, only one side line segment connecting the target point and the fifth vertex may be the stitch path. Because the regular hexagon may be formed by six side line segments, none of the remaining five side line segments need to be determined as the stitch path. Since the total length of five side line segments may be longer than the length of the one side line segment, the CPU 11 may move the stitch path to the five side line segments. That is, the CPU 11 may change the stitch path to the side line segments connecting the target point and the first vertex, the first and the second vertexes, the second and the third vertexes, the third and the fourth vertexes, and the fourth and the fifth vertexes when counted counterclockwise.

Figure 27:
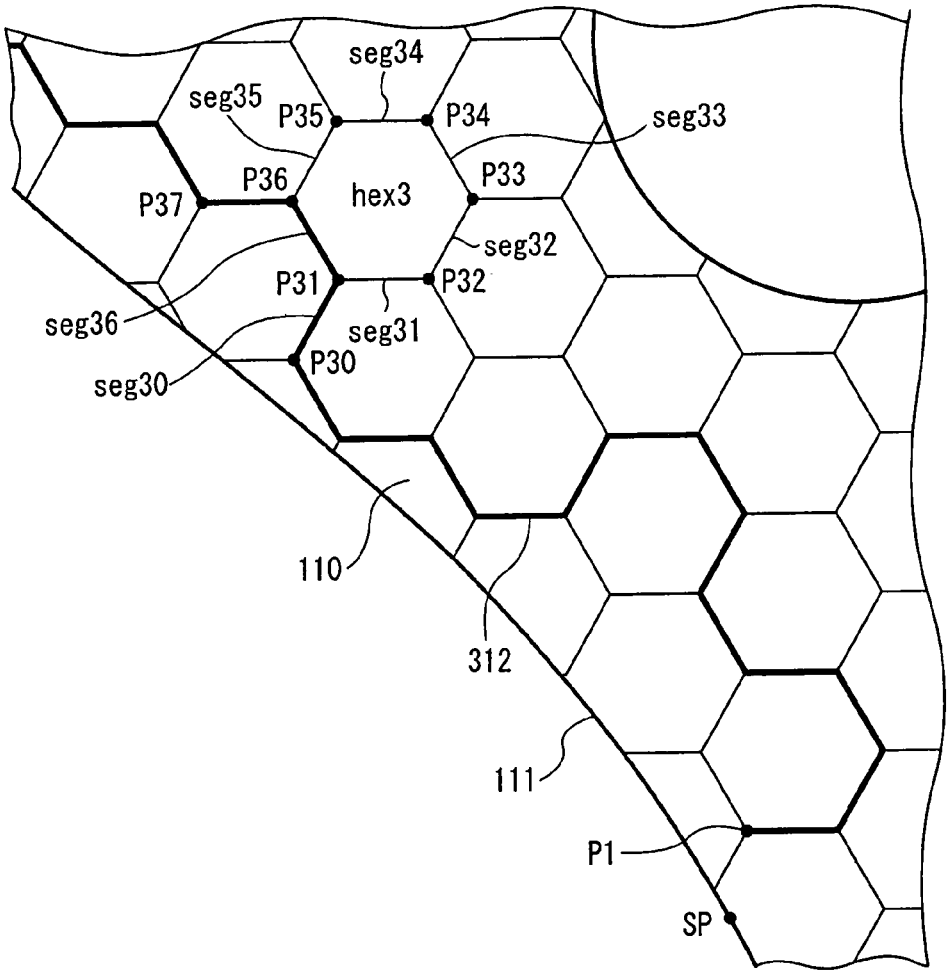
FIG. 27 is an explanatory diagram showing a case to which movement pattern B applies.

In the example shown in FIG. 27, a branch point P31 may be a target point and focus may be made on a regular hexagon hex3 having the respective vertexes of branch points P31, P32, P33, P34, P35, and P36 as a target hexagon and so traces branch points P32, P33, P34, P35, and P36 in this order in the regular hexagon hex3. In the regular hexagon hex3, only the side line segment seg36 which connects vertexes P31 and P36 may be the stitch path 312. For example, in the stitch path storage area 1207 may be stored the information of the branch points P30, P31, P36, P37 . . . in this order as the points on the stitch path 312. That is, none of the first, second, third and fourth vertexes (P32, P33, P34, and P35) may be on the stitch path, but the fifth vertex (P36) may be a point on the stitch path 312. Therefore, this state is determined as corresponding to the movement pattern B.

Accordingly, in the stitch path storage area 1207, the information of the branch points P32, P33, P34, and P35 may be stored between the branch point P31 (target point) and the P36 (the fifth point as counted counterclockwise from the target point), so that the information of the branch points P30, P31, P32, P33, P34, P35, P36, P37, . . . maybe stored in this order.

Figure 28:
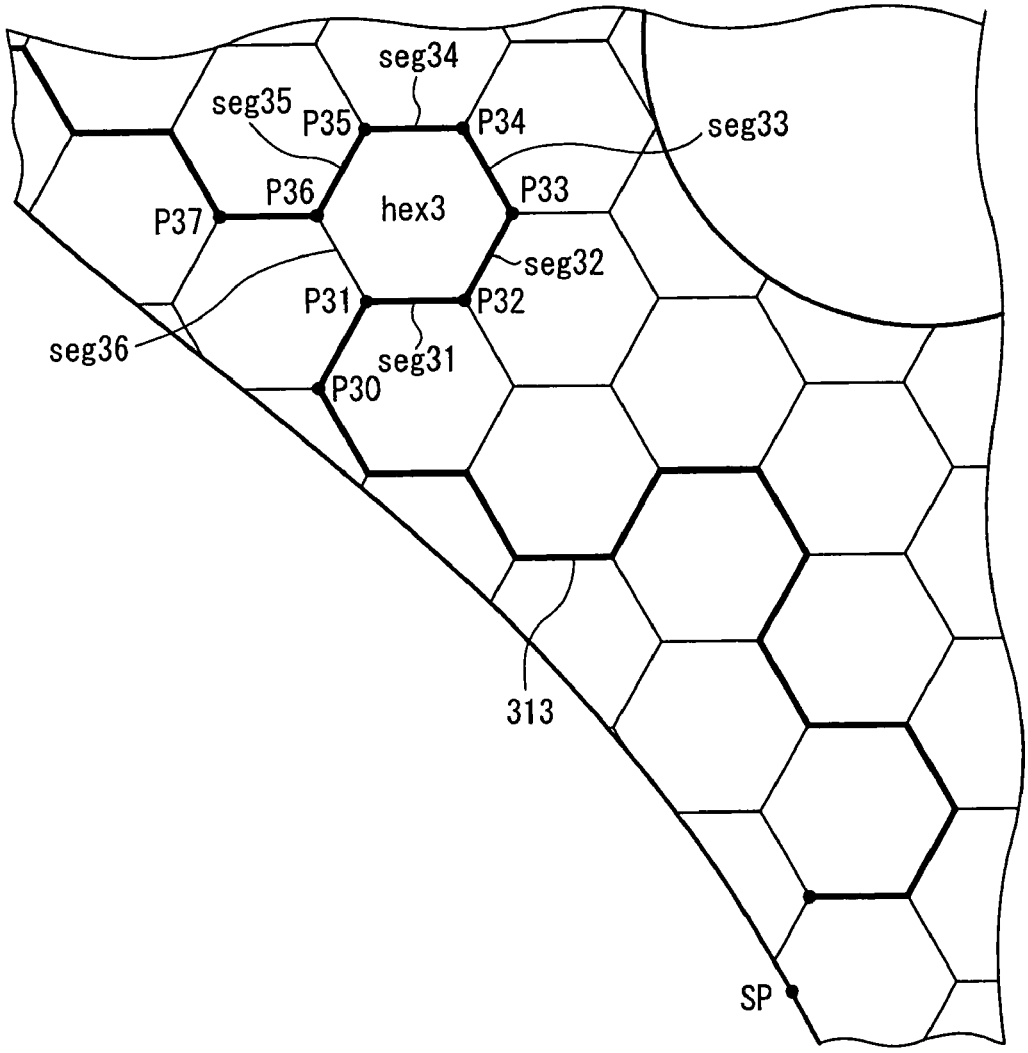
FIG. 28 is an explanatory diagram of a stitch path obtained by moving a part of the initial stitch path of FIG. 27.

As a result, as shown in FIG. 28, a side line segment seg31 connecting the target point P31 and the first vertex P32, a side line segment seg32 connecting the first vertex P32 and the second vertex P33, a side line segment seg33 connecting the second vertex P33 and the third vertex P34, a side line segment seg34 connecting the third vertex P34 and the fourth vertex P35, and a side line segment seg35 connecting the fourth vertex P35 and the fifth vertex P36 may be included on the stitch path 313 after the movement. In this example, the fifth vertex P36 is determined as the next target point.

The following will describe a method of determining which one of three peripheral regular hexagons of a target point is to be focused on as a target regular hexagon. As shown in FIG. 27, if the target point is the stitch path starting point P1, it may be determined whether each of the three peripheral side line segments is intersected by the profile 111 of the sewing area 110. The starting point SP may be set onto the profile line 111 of the sewing area 110 and a branch point closest to this starting point SP may be determined as stitch path starting point P1. Accordingly, at least one of the side line segments should be intersected by the profile line 111. In an exemplary case where only one of the peripheral side line segments is intersected, the regular hexagon that has the remaining two peripheral side line segments which are not intersected by the profile line 111 may be determined as the target regular hexagon. If two of the peripheral side line segments are intersected, none of the peripheral regular hexagons may be a target regular hexagon. Therefore, it may not determine whether the state corresponds to the movement pattern A or B. Then, the next point on the stitch path of the stitch path starting point P1 may be determined as the new target point.

If the target point is not the stitch path starting point P1, but another point on the stitch path, two peripheral side line segments may be focused on, excluding one side line segment which may be stitch path on the side where the movement determination may have already been made. A regular hexagon that has these two side line segments on the profile lines may be the target regular hexagon. In the example shown in FIG. 27, the side line segment serving as the stitch path on the side where movement determination has already been made may be the side line segment seg30 and the two side line segments other than side line segment seg30 may be the side line segments seg31 and seg36. Therefore, the regular hexagon hex 3 may be determined as the target regular hexagon.

Figure 30:
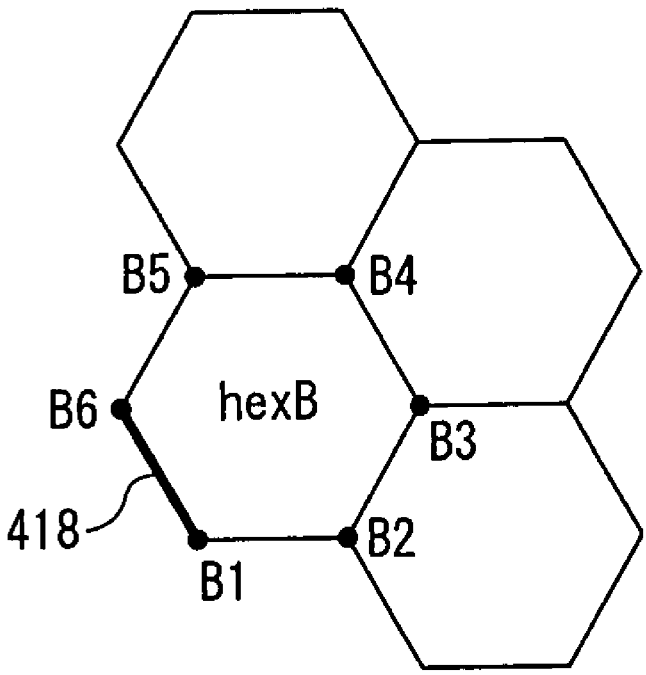
FIG. 30 is an explanatory diagram of a case to which a second case of movement pattern B in mode 1 applies.
Figure 31:
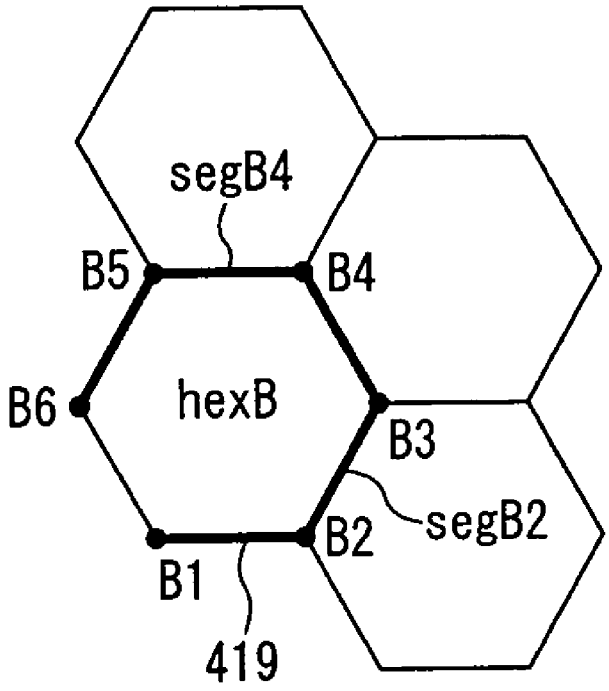
FIG. 31 is an explanatory diagram of a further case to which the second case of movement pattern B in mode 1 applies.

Next, a mode in which the probability of actually moving a stitch path if the stitch path corresponds to movement pattern A or B will be described below with reference to FIGS. 29-31. In the present exemplary embodiment, three modes of "mode 1", "mode 2", and "mode 3" are available and may be employed in this order. In the "mode 1", if the movement pattern A applies, one of two cases may be applied based on whether the target point may be on the initial stitch path 310. When the target point is on the initial stitch path 310, the probability of actually moving the stitch path may be 1/4. On the other hand, in a case where the target point was not on the initial stitch path 310, but is now on the stitch path as a result of movement of this stitch path, the probability of actually moving the stitch path may be 1/12.

Further, if the movement pattern B applies, there may be two cases depending on the type of the target point. The first case may be a case where the branch point next to the current target point in the clockwise direction may be a branch point that satisfies the following conditions: the branch point has been newly determined as a point on the stitch path when the stitch path was moved when its state corresponded to the movement pattern B, and the branch point has a vertex facing a vertex that was the target point in the regular hexagon when the stitch path was moved. For example, as shown in FIG. 29, the current target point may be a branch point B1. Further, the branch point B1 may have been determined as a new point on the stitch path, because the stitch path was moved from the stitch path connecting the branch point b1 and a branch point b6 to the stitch path connecting from the branch point b1 to the branch point b2, b3, b4, b5, and b6 in this order when the branch point b1 was the target point in a regular hexagon hexb. In this example, in the regular hexagon hexB, a branch point B6 next to the current target point B1 in the clockwise direction is located to face the branch point b1 that was the target point when the stitch path was moved in the regular hexagon hexb. This state may correspond to the first case when the movement pattern B applies. When this first case applies, the probability of actually moving the stitch path may be 0.

When the first case applies, the stitch path may be moved. In the example shown in FIG. 29, the stitch path constituted by a side line segment connecting the branch points B1 and B6 may be first moved to the stitch path that includes five side line segments connecting the branch points B1, B2, B3, B4, B5, and B6 in this order. In this state, if the branch point B3 is taken as the target point and the stitch path is further moved, the stitch path may extend to the upper right direction in FIG. 29. This may increase the probability that the resulting stitch path will have a poor shape. To avoid this situation, at the stage of mode 1, the probability may be set to 0 for the first case so that the stitch path may not be moved.

Figure 29:
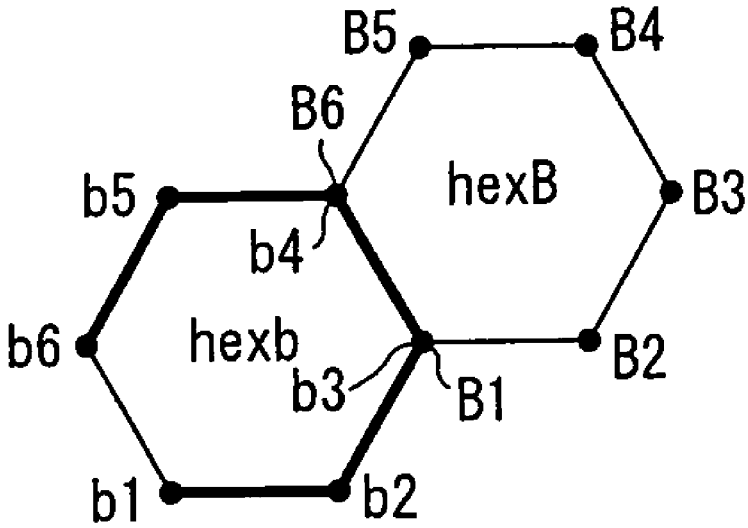
FIG. 29 is an explanatory diagram showing a case to which a first case of a movement pattern B applies.

The second case may be a case when the first case, as shown in FIG. 29, does not apply. The second case may be further classified into three cases according to the shape of the stitch path after being moved. An example of the target point B1 is shown in FIG. 30. If only the side line segment connecting the branch points B1 and B6 is a stitch path 418 as shown, when the stitch path 418 is moved as shown in FIG. 31, five side line segments connecting the branch points B1, B2, B3, B4, B5, and B6 may be determined as a stitch path 419. Considering the stitch path 419 previously moved, three cases may be provided based on whether the side line segment segB2 connecting the branch points B2 and B3 may be moved according to the movement pattern B and whether side line segment segB4 connecting the branch points B4 and B5 may be moved according to the movement pattern B.

If the movement pattern B may be applied to both of the side line segments segB2 and segB4, the probability of actually moving the stitch path may be 1/3. Further, if the movement pattern B may be applied to only one of the side line segments segB2 and segB4, the probability of actually moving the stitch path may be 1/15. Even further, if the movement pattern B may be applied to neither of the side line segments segB2 and segB4, the probability of actually moving the stitch path may be 0. The fact that the movement pattern B may be applied to neither of the side line segments segB2 and segB4 means that there may be no possibility of further moving the stitch path after the movement, which may result in a stitch path with a complicated shape. On the other hand, the fact that the movement pattern B may be applied to one of the side line segments segB2 and segB4 means that there may be a possibility of further moving the stitch path after the movement, which may result in a stitch path with a complicated shape. Further, the fact that the movement pattern B may be applied to both of the side line segments segB2 and segB4 means that there may be a higher possibility of further moving the stitch path after the movement, which results in a stitch path with a complicated shape. Therefore, the higher the possibility of further moving the stitch path after the movement and developing into a complicated shape, the higher the probability becomes.

Next, the "mode 2" will be described below. In the mode 2, if the movement pattern A applies, the probability of actually moving the stitch path may be set to 1/4. On the other hand, if the movement pattern B applies, similar to the mode 1, there may be two cases, which are classified based on the type of the target point. In the first case, that is, in a case where a branch point next to the current target point in the clockwise direction is a branch point that has been newly determined as the point on the stitch path when the stitch path was moved as its state corresponded to the movement pattern B and that was a vertex facing the target point in the regular hexagon when the stitch path was moved, the probability of actually moving the stitch path may be set to 0. If the target point does not correspond to the first case, that is, if the second case applies, the probability may be set to 1.

Next, the "mode 3" will be described below. In the mode 3, in both cases where the movement pattern A and the movement pattern B apply, the probability of actually moving the stitch path may be set to 1. That is, if the state corresponds to one of the two movement patterns, the stitch path should be moved.

In such an example, the probability of actually moving the stitch path may increase in the order of modes 1, 2, and 3. In mode 3, if any one of the movement patterns applies, the stitch path may be moved. Therefore, if the processing is performed repeatedly on the branch points on the stitch path in mode 3, there may be no branch point whose state corresponds to the movement pattern A or B in the end.

Figure 6:
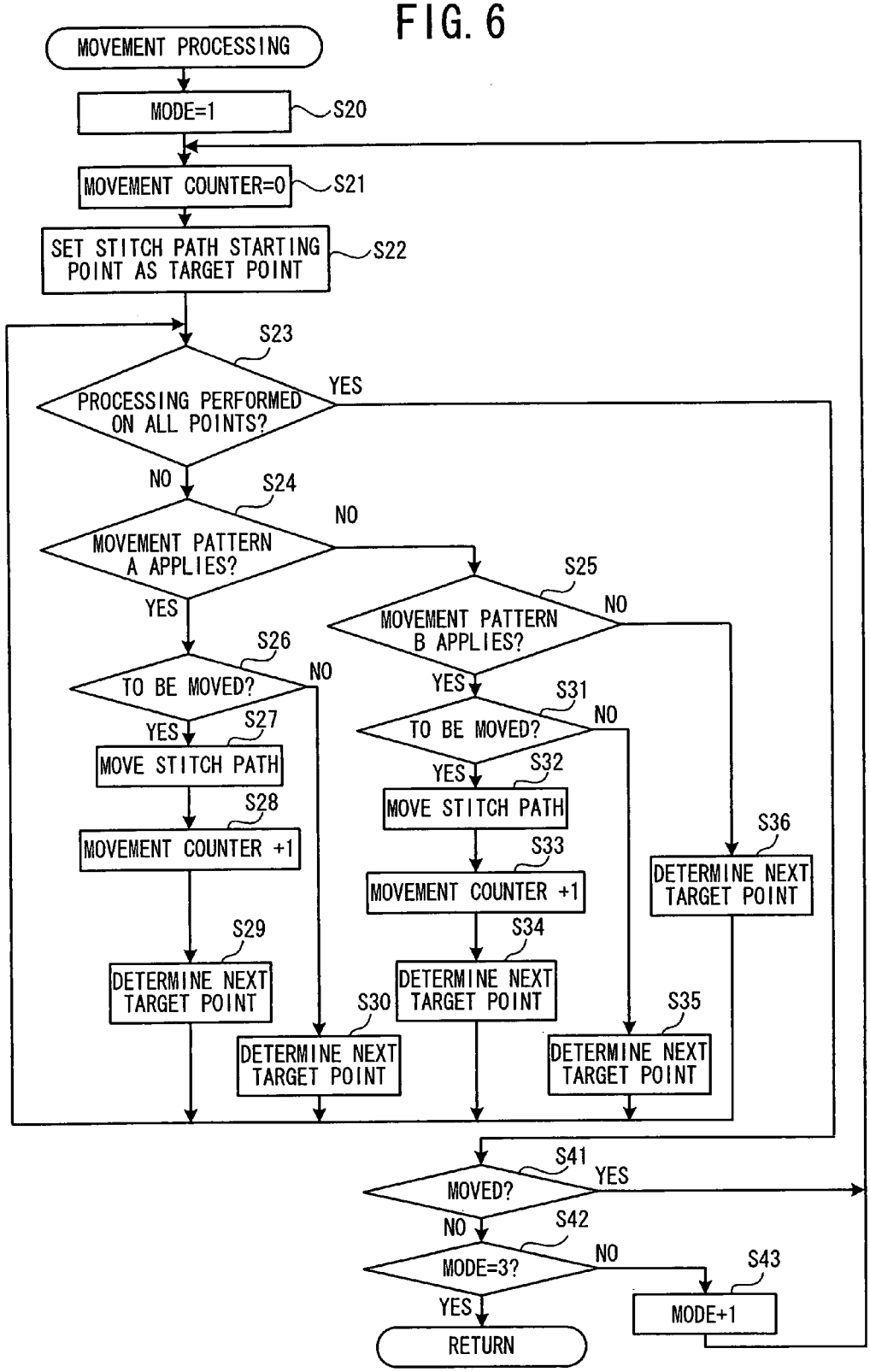
FIG. 6 is a flowchart of movement processing which is performed in the main processing.

The following will describe in detail the movement processing with reference to the flowchart of FIG. 6. First a value that indicates the "mode 1" (for example, 1) maybe stored in the mode storage area 1211 (S20). Next, an initial value of 0 may be stored in a movement counter for counting the number of times the stitch path is actually moved (S21). Next, a value indicating the stitch path starting point P1 may be set as a target point in the target point storage area 1212 (S22). For example, the coordinates of the branch points that form the stitch path may be stored in the stitch path storage area 1207 in the order of forming the stitch path. Accordingly, the sequence number of the stitch path staring point P1 may be stored in the stitch path storage area 1207, for example, 1 may be stored in the target point storage area 1212.

Then, it may be determined whether the processing has been performed on all of the branch points (S23). For example, it may be determined whether the target point is the stitch path ending point P99. For example, if the value stored in the target point storage area 1212 is equal to the number of the coordinates of the branch points stored in the stitch path storage area 1207, it may be determined that the target point is the stitch path ending point P99.

If the processing has not yet been performed on all of the branch points (NO in S23), it may first be determined whether the movement pattern A applies (S24). The determination may be based on whether the above-described movement pattern A applies, that is, whether the first, second, and third vertexes of a target regular hexagon are not on the stitch path and the fourth vertex is on the stitch path.

If it is determined that the movement pattern A applies (YES in S24), a determination may be made based on the probability of actually moving the stitch path (S26). For example, the probability defined for the mode may be used, as described above. Since the current mode in this example is the "mode 1", the probability is 1/4 if the target point is on the initial stitch path. On the other hand, the probability may be 1/12, if the target point is not on the initial stitch path; that is, if the target point is on the stitch path after the movement.

The determination of the probability may be made based on random numbers. To obtain the random numbers, a known random number generation program may be used. If a predetermined value is given to the random number generation program as an argument, the predetermined number is may be passed the random number. In an exemplary embodiment, by giving the sequence number of the target point on the stitch path as the argument to the random number generation program, the random number may be obtained. In determination of whether to actually move the stitch path, values for determining to "move" based on a defined probability may be beforehand. Then, it may be determined whether to move the stitch path according to whether the obtained random number is one of the defined values or not. The number of the random numbers generated by the random number generation program may be defined by the random number generation program. For example, if the probability is 1/4, ¼ of the number of the random numbers generated by the random number generation program may be defined as values based on which determination is made to "move". Those values may be stored in the miscellaneous information storage area 123 in the hard disk drive 120.

If the starting point SP and ending point EP are at the same position in the same sewing area 110, the initial stitch path 310 may also be the same. Therefore, the branch points to be the target points in the movement processing and arguments given to the random number generation program may also be the same. Accordingly, for example, if the starting point SP and ending point EP are at the same position for the same sewing area 110, no matter how many times the present processing is performed, the initial stitch path 310 may be moved based on the same target points, resulting in the same stitch path 410. Even if the starting point SP and the ending point EP are not at the same position, the same stitch path 410 may be created as far as the stitch path starting point P1 determined on the basis of the starting point SP and the stitch path ending point P99 determined on the basis of ending point EP may be set to the same branch point.

If it is determined to "move" the stitch path (YES in S26), the stitch path may be moved according to the movement pattern A (S27) as described above with reference to FIGS. 25 and 26, and the movement counter may be incremented by 1 (S28). Then, the fourth vertex, as counted from the current target point counterclockwise may be set as the next target point and stored in the target point storage area 1212 (S29). In the example shown in FIG. 26, the fourth branch point P6 on the stitch path may be set as the next target point. Then, the process returns to S23.

On the other hand, if it is not determined to "move" the stitch path (NO in S26), a branch point following the current target point on the stitch path may be set as the next target point (S30) and the process returns to S23. More specifically, the value in the target point storage area 1212 is incremented by 1.

If the movement pattern A does not apply (NO in S24), it may be determined whether the movement pattern B applies (S25). This determination may be made on whether the current state corresponds to the above-described movement pattern B, that is, whether the first, second, third, and fourth vertexes of a target regular hexagon, are not on the stitch path, but the fifth vertex is on the stitch path.

If it is determined that the state corresponds to the movement pattern B (YES in S25), it may then be determined whether the stitch path is to be actually moved based on a probability of actually moving the stitch path (S31). For example, the predetermined probability for the current mode as described above may be used. Because the current mode is the "mode 1", in the above-described first case, the probability of actually moving the stitch path is 0. Therefore, if the current state corresponds to the first case, it may not be determined to move the stitch path (NO in S31).

On the other hand, if the current state does not correspond to the first case, but corresponds to the second case, as described above with reference to FIGS. 30 and 31, the probability may be determined according to the shape of the stitch path after being moved. If, as shown in FIG. 31, the movement pattern B may be applied to both of the side line segments segB2 and segB4 on the stitch path after the movement, the probability of actually moving the stitch path may be 1/3. Further, if the movement pattern B may be applied to only one of the side line segments segB2 and segB4, the probability of actually moving the stitch path may be 1/15. Even further, if the movement pattern B may be applied to neither of side line segments segB2 and segB4, the probability of actually moving the stitch path may be 0.

Similar to the case of the movement pattern A, the random numbers generated by the random number generation program may be employed to determine whether the stitch path is to be actually moved.

If it is determined to "move" the stitch path (YES in S31), the stitch path may be moved according to the movement pattern B (S32), and the movement counter is incremented by 1 (S33) as described above with reference to FIGS. 27 and 28. Then, the fifth vertex, may be set as the next target point and stored in the target point storage area 1212 (S34). In the example shown in FIG. 28, the fifth branch point P36 on the stitch path is set as the next target point. Then, the process may return to S23.

On the other hand, if it is determined to "move" the stitch path (NO in S31), the next branch point of the branch point currently being the target point on the stitch path may be set as the next target point (S35), and the process returns to S23. For example, the value in the target point storage area 1212 may be incremented by 1.

Further, if the current state does not correspond to the movement pattern B (NO in S25),the next branch point of the branch point currently being the target point on the stitch path may be set as the next target point (S36), and the process may return to S23. For example, the value in the target point storage area 1212 may be incremented by 1.

Then, the processing of S23-S36 may be repeated and, if it is determined that the movement pattern A or B may be applied and that the stitch path is to be moved, the processing of moving the stitch path may be performed. If the target point becomes the stitch path ending point P99 and all of the branch points have been through the processing, the process may advance to S41.

In S41, it may be determined whether the stitch path has been moved (S41). The determination may be made by checking whether the value of the movement counter is at least 1. If the stitch path has been moved (YES in S41), there still may exist a possibility that the stitch path may be further moved in the "mode 1." Therefore, the process may return to S21 to initialize the movement counter to 0 (S21) and the stitch path starting point P1 may be set as the target point (S22). Then, the processing of S23-S36 may be repeated and, if it is determined that the movement pattern A or B may be applied and the stitch path is to be moved, the processing of moving the stitch path may be performed. If the target point becomes the stitch path ending point P99 and all of the branch points have been through the processing, the process may advance to S41.

Then, the processing of S21-S41 may be repeated and if the stitch path should not be moved any more in the "mode 1" (NO in S41), it may be determined whether the process is in the "mode 3" (S42). Because it may still be in the "mode 1", not in the "mode 3" (NO in S42), 1 is added to the value stored in the mode storage area 1211 to proceed to the "mode 2" (S43). Then, the process may return to S21.

Then, the processing of S21-S36 may be repeated in the "mode 2". This time, in S26 and S31, the predetermined probability for the "mode 2" may be employed to determine whether to move the stitch path. For example, if the movement pattern A applies (YES in S24), it may be determined to move the stitch path at a probability of 1/4. In a case where the movement pattern B applies (NO in S25) and the state corresponds to the first case, the probability of actually moving the stitch path may be 0 and so it may not be determined to move the stitch path (NO in S31). On the other hand, if the state does not correspond to the first case, the probability may be 1 and it may be determined that the stitch path should be moved (YES in S31).

In the "mode 2", the processing of S21-S36 maybe repeated and, if it is determined that the movement pattern A or B may be applied and the stitch path is to be moved, the processing of moving the stitch path may be performed. If the target point becomes the stitch path ending point P99 and all of the branch points have been through the processing, the process may advance to S41.

In S41, it may be determined whether the stitch path has been moved (S41). The determination may be made by checking whether the value of the movement counter is at least 1. If the stitch path has been moved (YES in S41), there still exists a possibility that the stitch path may be further moved in the "mode 2", so that the process returns to S21 to initialize the movement counter to 0 (S21), and the stitch path starting point P1 may be set as the target point (S22). Then, the processing of S23-S36 may be repeated and, if it is determined that the movement pattern A or B may be applied and the stitch path is to be moved, the processing of moving the stitch path may be performed. If the target point becomes the stitch path ending point P99 and all of the branch points have been through the processing, the process may advance to S41.

Thus, the processing of S21-S41 is repeated, and if the stitch path may not be moved any more in the "mode 2" (NO in S41), it may be determined whether the process is in the "mode 3" (S42). In this example, because it is in the "mode 2", not in the "mode 3" (NO in S42), 1 may be added to the value stored in the mode storage area 1211 to proceed to the "mode 3" (S43). Then, the process may return to S21.

Then, the processing of S21-S36 may be performed in the "mode 3". Here, in S26 and S31, the predetermined probability for the "mode 3" may be employed to determine whether to actually move the stitch path. For example, in both cases where the movement patterns A or B apply, the probability may be 1. In other words, in both of a case where the movement pattern A applies (YES in S24) and a case where the movement pattern B applies (YES in S25), it may be determined that the stitch path is to be moved (YES in S26, YES in S31).

In the "mode 3", the processing of S21-S36 may be repeated and, if it is determined that the movement pattern A or B may be applied and the stitch path is to be moved, the processing of moving the stitch path may be performed. If the target point becomes the stitch path ending point P99 and all of the branch points have been through the processing, the process may advance to S41.

In S41, it may be determined whether the stitch path has been moved (S41). The determination may be made by checking whether the value of the movement counter is at least 1. If the stitch path has been moved (YES in S41), the stitch path may be further moved in the "mode 3", so that the process returns to S21 to initialize the movement counter to 0 (S21), and the stitch path starting point P1 may be set as the target point (S22). Then, the processing of S23-S36 may be repeated and, if it is determined that the movement pattern A or B may be applied and the stitch path is to be moved, the processing of moving the stitch path may be performed. If the target point becomes the stitch path ending point P99 thereby indicate that all of the branch points have been through the processing, the process may advance to S41.

Then, the processing of S21-S41 may be repeated, and if the stitch path may not be moved any more in the "mode 3" (NO in S41), it may be determined whether the process is in the "mode 3" (S42). In this example, because the process is in the "mode 3" (YES in S42), the present movement processing may be terminated, and the process may return to the main processing.

By thus performing the movement processing, as indicated above, the stitch path of the initial stitch path 310 (see FIG. 11) may be moved to create the stitch path 410 (see FIG. 12). For example, if the target regular hexagon has a smaller number of the side line segments (which may have already been determined as the stitch path) than the number of the other side line segments (which may not have been determined as the stitch path), the stitch path may be moved. However, if condition that the stitch path is always moved when the movement pattern A or B is applied, the stitch path may be moved first at the branch point on the side closer to the stitch path starting point P1. As a result, the stitch path may spread out more on the side closer to the stitch path starting point P1 than on the side closer to the stitch path ending point P99. The process may produce such embroidery data as to form stitches of an unbalanced and unattractive shape. To avoid this situation, rather than always moving the stitch path, the stitch path may be moved in some cases and not moved in other cases, according to determination result on whether to actually move the stitch path based on a probability defined for each of the modes. This prevents the stitch path from spreading out more on the side closer to the stitch path starting point P1, thereby enabling obtaining sewing data that may form stitches of a high quality shape.

Figure 32:
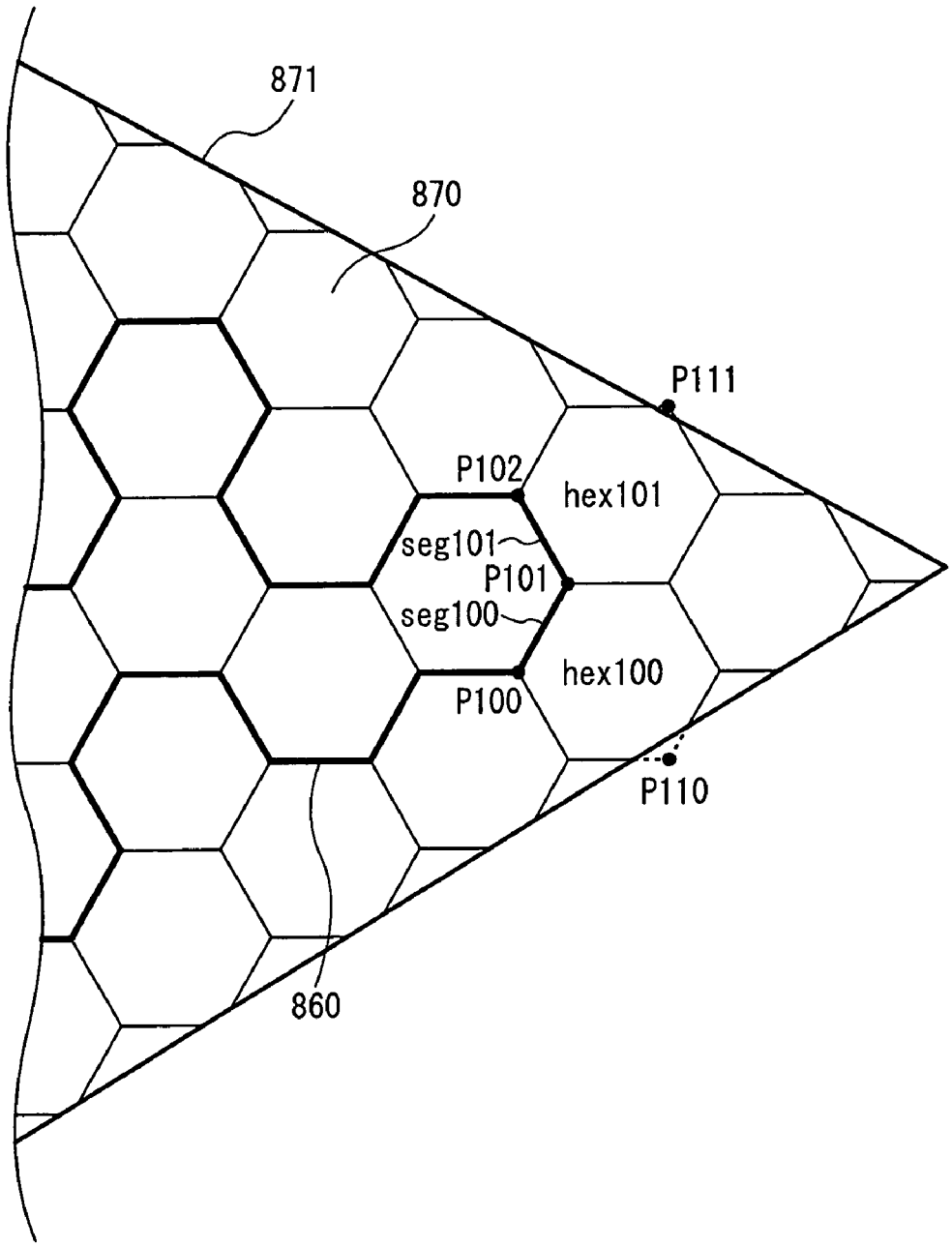
FIG. 32 is an explanatory diagram of a stitch path which undergoes special processing after the stitch path is created.

Next, the special processing (S7 of FIG. 5) will be described below with reference to FIGS. 32-34. The special processing may be performed after the stitch path 410 is created. Here, focus may be on branch points P100 and P101 shown in FIG. 32. In the above-described movement processing (see S6 of FIG. 5 and FIG. 6), in a case where the branch point P100 is a target point, a second vertex P110 may exist outside a sewing area 870. Therefore, the movement pattern A or B should not be applied, so that a side line segment seg100 connecting the branch points P100 and P101 that constitutes a part of a stitch path 860 may not be moved. Similarly, in a case where focus is on this branch point P101 as a target point, a counterclockwise third vertex P111 of a target regular hexagon hex 101 may exist outside the sewing area 870. Therefore, side line segment seg101 connecting the branch points P101 and P102 that constitutes a part of the stitch path 860 may not be moved.

Figure 33:
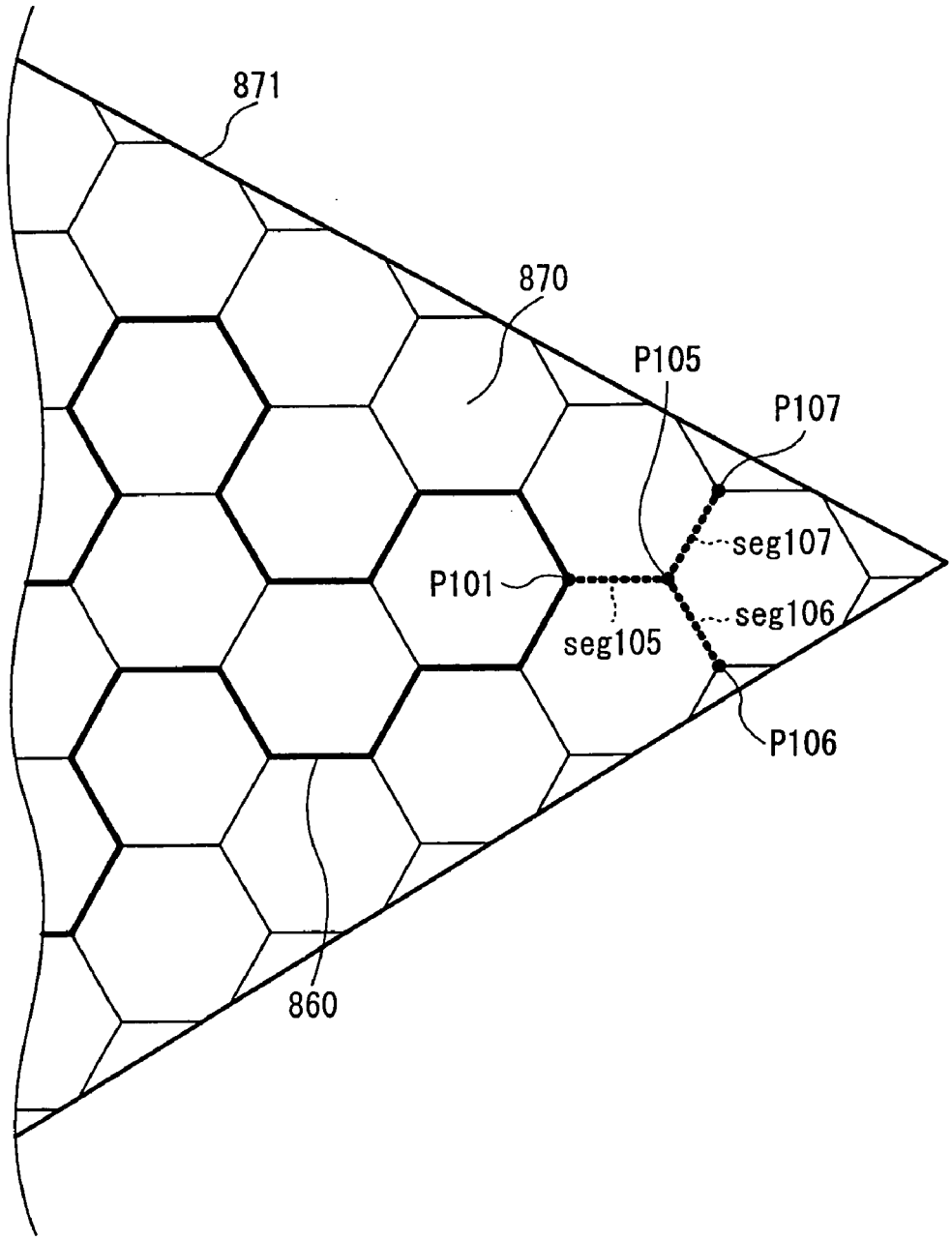
FIG. 33 is an explanatory diagram of the stitch path which undergoes the special processing.

As shown in FIG. 33, among three peripheral side line segments of the branch point P101, the side line segment seg105 may not constitute a part of the stitch path 860. When focusing on the side line segment seg105, it may not be intersected by a profile line 871 of the sewing area 870. Moreover, neither of side line segments seg106 and seg107 that branch from the branch point P105, which is one endpoint of the side line segment seg105 having the branch point P101 as the other endpoint, may be intersected by the profile line 871. That is, the regular hexagon itself should not expand any more but the side line segments may expand further alone.

Figure 34:
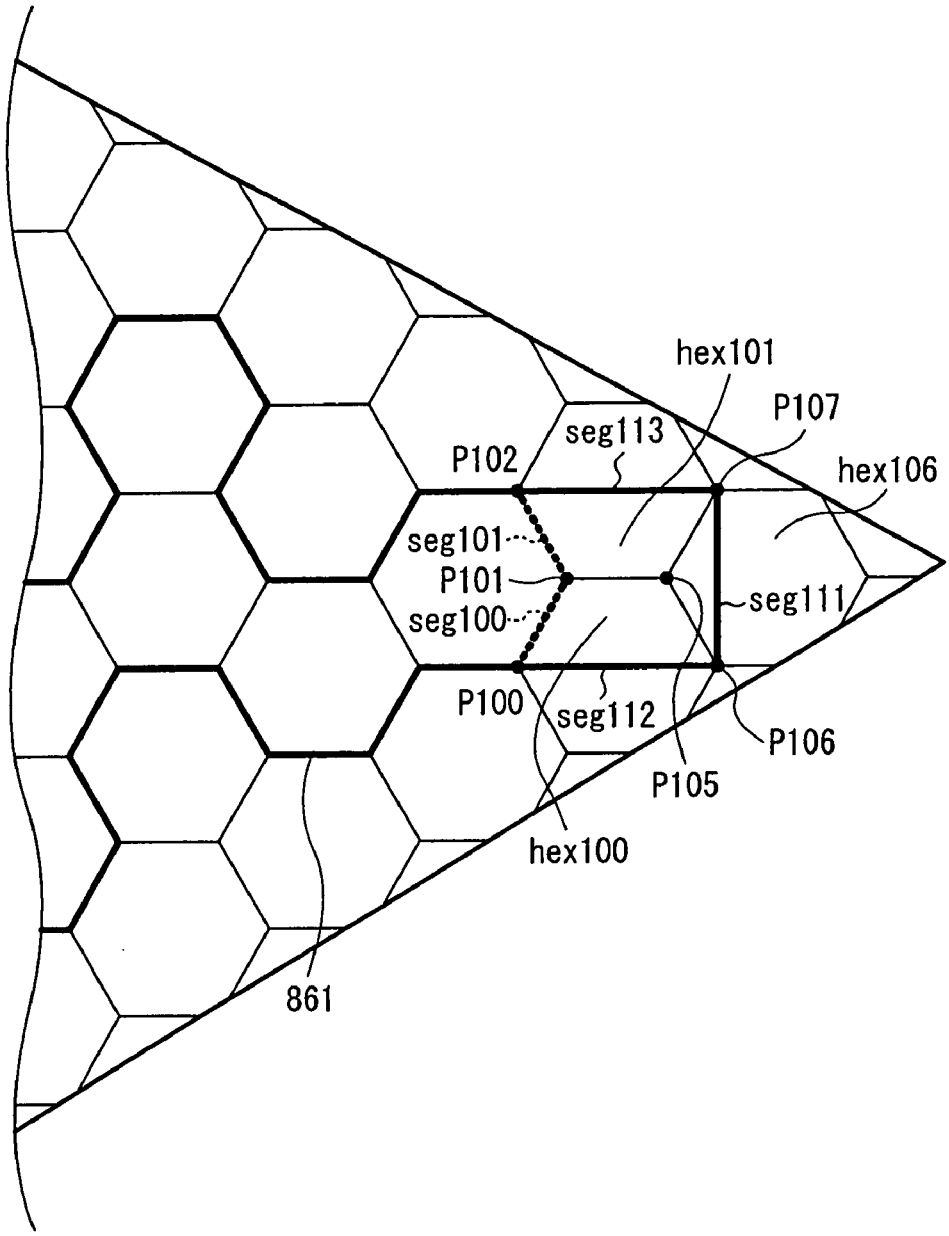
FIG. 34 is an explanatory diagram of a stitch path obtained after the special processing on the stitch path.

Considering this, as shown in FIG. 34, the branch point P100 and a branch point P106 may be connected to each other, thereby forming a new line segment seg112. The branch point P100 may be one endpoint of the side line segment seg100 having the branch point P101 as the other endpoint. The branch point P106 may be a vertex facing the branch point P100 in the regular hexagon hex100 having the side line segment seg100 as its profile line. Then, a branch point P102 and a branch point P107 may be connected to each other, thereby forming a new line segment seg113. The branch point P102 may be one endpoint of the side line segment seg101 having the branch point P101 as the other endpoint. The branch point P107 may be a vertex facing the branch point P102 in the regular hexagon hex101 having the side line segment seg101 as its profile line. Then, by connecting the branch points P106 and P107 to each other, new line segment seg111 may be created. Next, the side line segments seg100 and seg101 may be excluded from the stitch path and the newly created line segments seg112, seg111, and seg113 may be determined as the stitch path. A new stitch path 861 may thus be obtained.

For example, from the information of the branch points P100, P101, and P102 previously stored in this order in the stitch path storage area 1207, the information of the branch point P101 may be deleted. Instead, the information of the branch points P106 and P107 may be inserted. Consequently, the information of the branch points P100, P106, P107, and P102 may be stored in this order in the stitch path storage area 1207.

Figure 35:
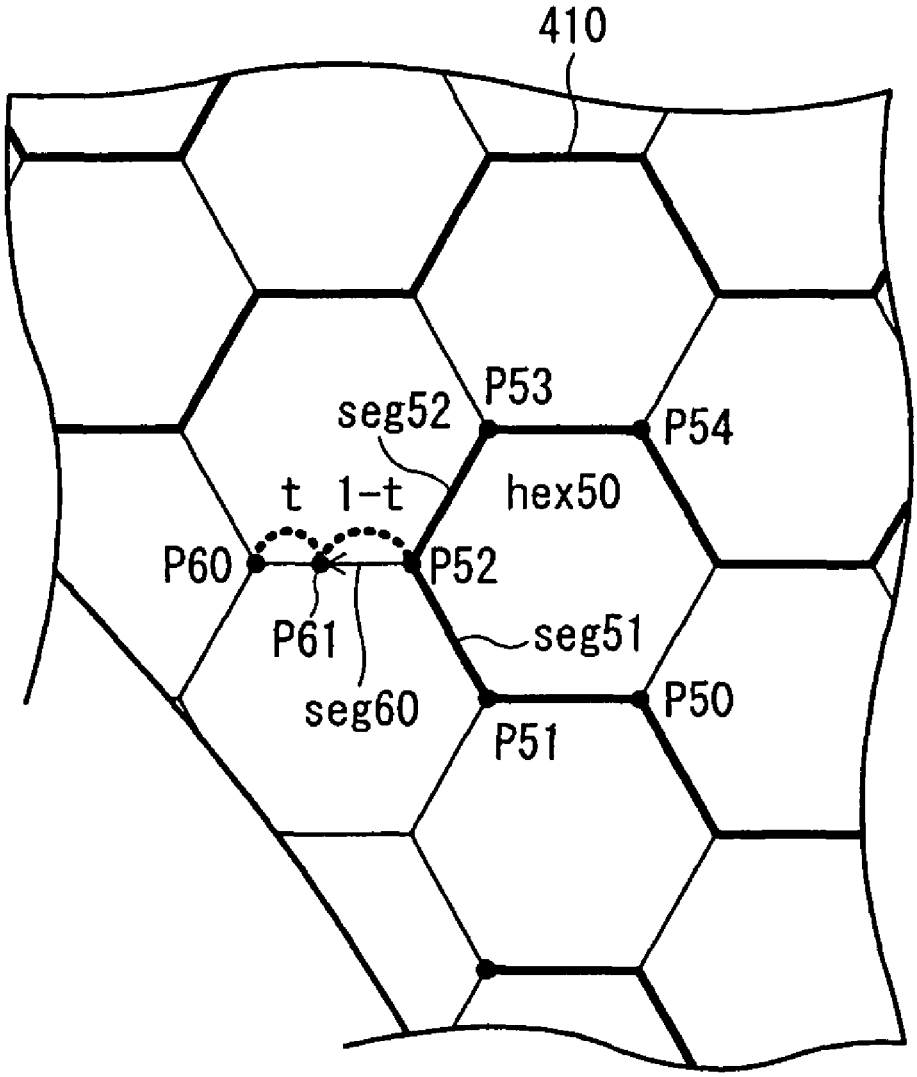
FIG. 35 is an explanatory diagram showing a point to which a branch point on a stitch path is moved at the first stage.
Figure 36:
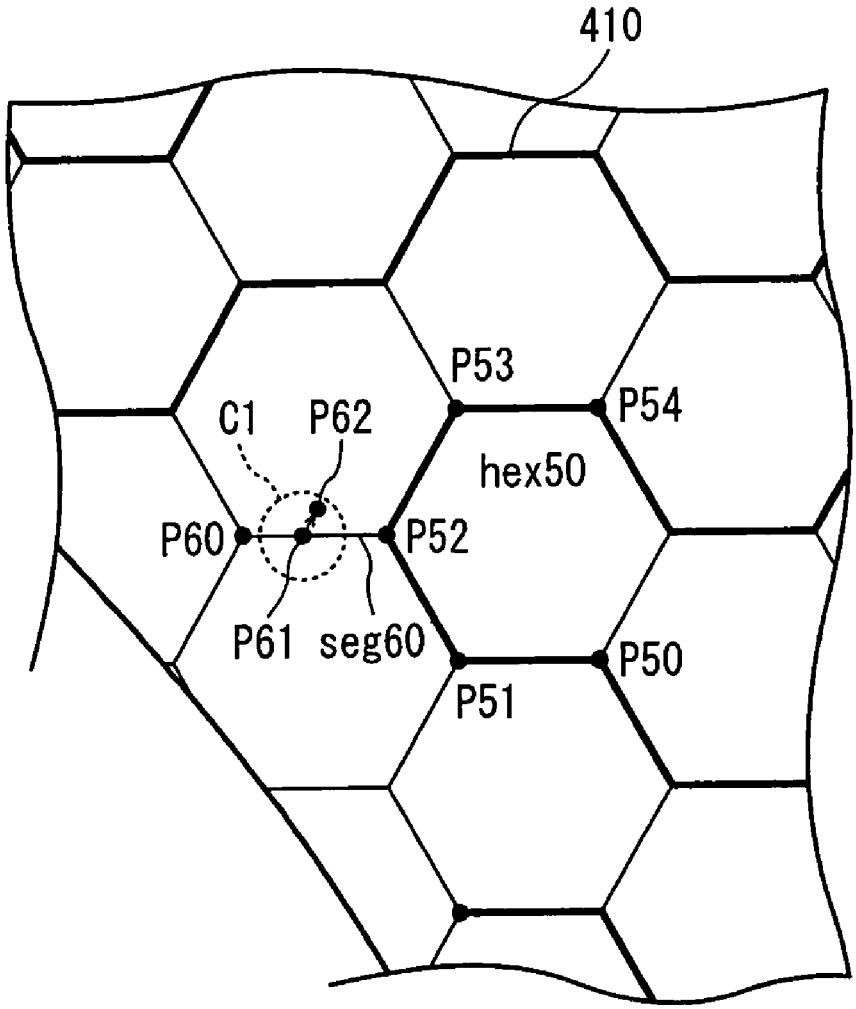
FIG. 36 is an explanatory diagram showing a point to which the branch point on the stitch path is moved at the second stage.
Figure 37:
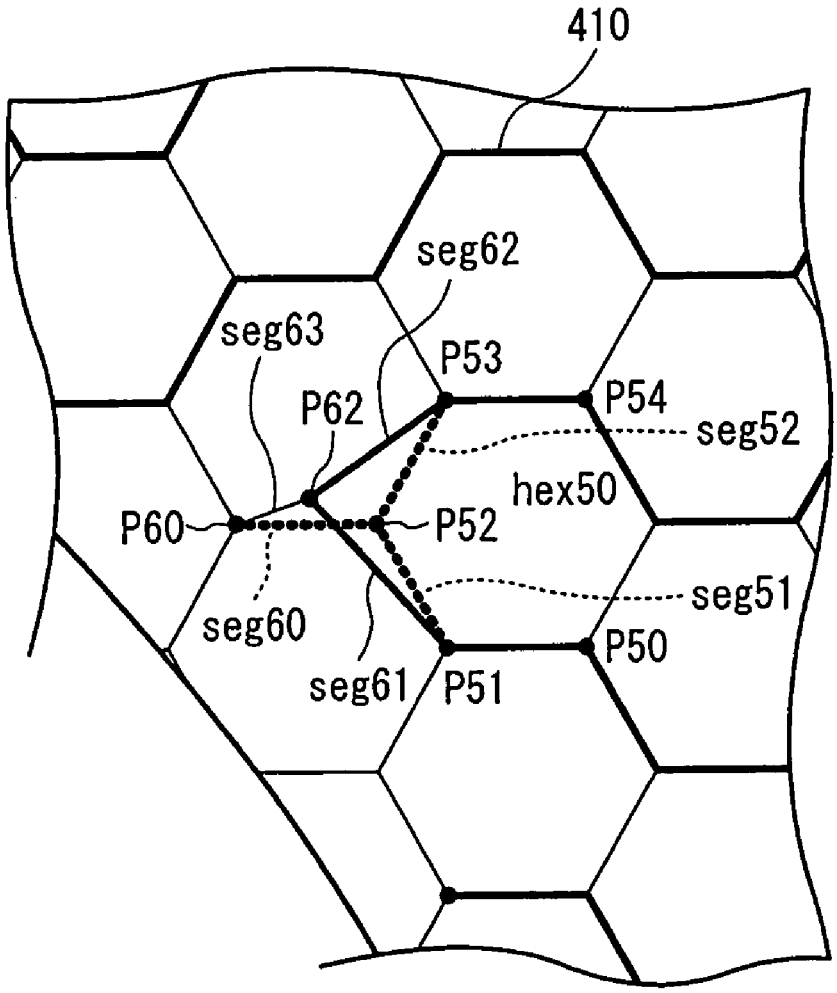
FIG. 37 is an explanatory diagram of a stitch path obtained after moving coordinates of a branch point to coordinates of another point.

Next, the processing of creating the transformed stitch path 510 (S8 of FIG. 5) will be described in detail below with reference to FIGS. 35-37. The transformed stitch path 510 may be created by transforming the stitch path 410 evenly arranged in the sewing area 110 by moving its branch points. In an exemplary embodiment, a first movement and a second movement may be performed on all of the branch points on the stitch path 410.

First, the first movement will be described below using a branch point P52 shown in FIG. 35 as an example. In this example, out of three peripheral side line segments of a branch point P52, a side line segment seg60 is not a stitch path. A point P61 that internally divides the side line segment seg60 at a ratio of t:(1−t) may be a movement destination of the branch point P52 by the first movement. In other words, for example, (connecting the branch points P60 and P61): (line segment connecting the branch points P61 and P52)=t: (1−t). As the value of t, for example, a value that indicates a sequence of the branch point P52 along the stitch path may be given to a known random number generation program as an argument, and a numeral generated by the program may be employed. The random number generation program may be the same with or different from the program used in the movement processing. In this step, coordinates of the branch point P52 in the stitch path storage area 1207 may be changed into those of the point P61.

Subsequently, the second that movement may be performed. As shown in FIG. 37, in the second movement, P61 that is obtained by the first movement, may be moved to an arbitrary point P62 in a circle C1 having the point P61 as its center and r as its radius. The radius r may be set based on a reference distance stored in the reference distance storage area 1201. In the present embodiment, it may be supposed that radius r=(referenced distance)/5.0. The arbitrary point P62 in circle C1 is determined by, for example, the following method. First, two values of numerals A and B may be generated by the random number generation program. These values have their respective possible ranges of 0≦(numeral A)≦(radius r of circle C1) and 0≦(numeral B)≦360. With these values, the x-coordinate of the arbitrary point P62 may be set as (x-coordinate of center point P61)+(numeral A)×cos (numeral B) and the y-coordinate may be set as (x-coordinate of center point P61)+(numeral A)×sin(numeral B). Then, the coordinates of the branch point P61 in the stitch path storage area 1207 may be changed into those of P62.

The first movement and the second movement may be performed in such a manner to change the coordinates of the branch point P52 into those of P62. Consequently, as shown in FIG. 37, a side line segment seg51 connecting the branch points P51 and P52 may be changed into a side line segment seg61, and a side line segment seg52 connecting the branch points P52 and P53 may be changed into a side line segment seg62. As a result, a regular hexagon hex50 may be changed into a hexagon with a smaller angle than 120 degrees formed by the side line segments seg61 and seg62.

The above-described first movement and second movement may be performed on all of the branch points on the stitch path 410 evenly arranged in the sewing area 110 by the movement processing (S6 of FIG. 5) and the special processing (S7 of FIG. 5), thereby creating the transformed stitch path 510 (see FIG. 13).

Next, determination of coordinates of needle drop points from the curve path 610 may be described below with reference to FIGS. 38 and 39. The determination of coordinates of needle drop points may be carried out in the stitch creation processing (S10 of FIG. 5). The transformed stitch path created by the first movement and the second movement in the transformation processing (S8 of FIG. 5) described above may be changed by Bezier curve processing (S9 of FIG. 5) into a Bezier curve, thus creating a curve path.

In the following, for simplification, it will be described using as an example a curve path 650 having a stitch path starting point P601 and a stitch path ending point P602 shown in FIG. 38. As shown in FIG. 38, the curve path 650 may be represented by a plurality of points disposed densely on the curve. The curve storage area 1208 may store the coordinates of these points sequentially from the stitch path starting point P601 to the stitch path ending point P602.

First, it may be sequentially determined whether an angle formed at each of the points that constitute the curve path 650 as a vertex is less than 120 degrees, starting from the next point to the stitch path starting point P601. In the case of the n'th point, the angle between a line segment connecting the (n−1)'th point and the n'th point and a line segment connecting the n'th point and the (n+1)'th point may be compared with 120 degrees. If the angle is less than 120 degrees, the point may be determined as a feature point. In the example shown in FIG. 38, a point P600 is determined as a feature point. At the feature point, the curve path 650 may be divided. In the example shown in FIG. 38, the curve path 650 may be divided into a divided curve 651 connecting the stitch path starting point P601 and the feature point P600 and a divided curve 652 connecting the feature point P600 and the stitch path ending point P602. If there is m number of feature points, the curve may be divided into (m+1) number of divided curves. If there is no feature point, the curve path should not be divided and the following processing may be performed on it as one curve.

First, the number of needle drop points to be disposed on each of the divided curves may be calculated. For this purpose, the length of the divided curves may first be calculated. To calculate the length, the distance between each pair of the neighboring points may be added up. Then, the length may be divided by the stitch length stored in the stitch length storage area 1202 to obtain a quotient. Then, the quotient may be rounded to the whole number and 1 is added to it, which provides the number of the needle drop points which may be disposed on the divided curve.

Next, a distance between the needle drop points on this divided curve may be calculated. For example, it may be assumed that (distance between the needle drop points)= (length of the divided curve)/(number of needle drop points). Then, as shown in FIG. 39, a first needle drop point may be disposed at one end of the divided curve. The next needle drop point may be disposed at a point on the divided curve moved forward from the first needle drop point for the calculated distance between the needle drop points. Similarly, the next needle drop point may sequentially be disposed at a point on the divided curve moved forward from that preceding needle drop point by the distance between the needle drop points. Finally, the other end of the divided curve may be determined as the last needle drop point. In this case, the coordinates of the previously determined needle drop points may be stored in the stitch information storage area 1209.

Figure 39:
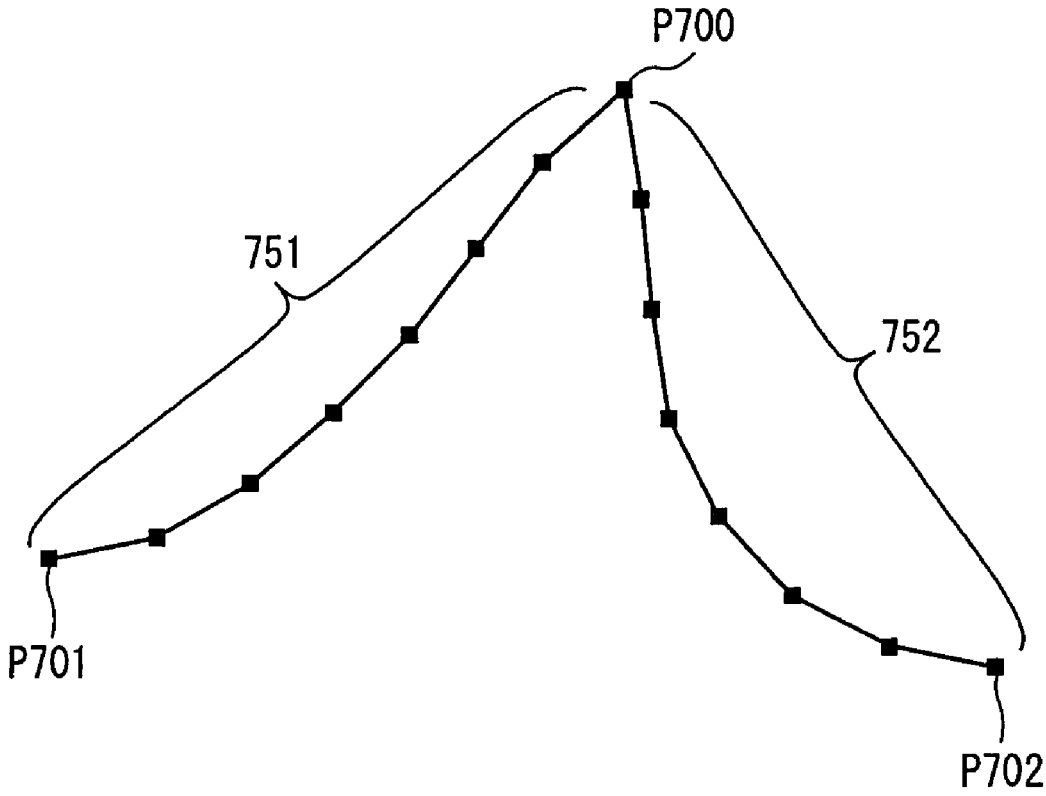
FIG. 39 is an explanatory diagram of a needle drop points created from the curve path shown in FIG. 38.
Figure 40:
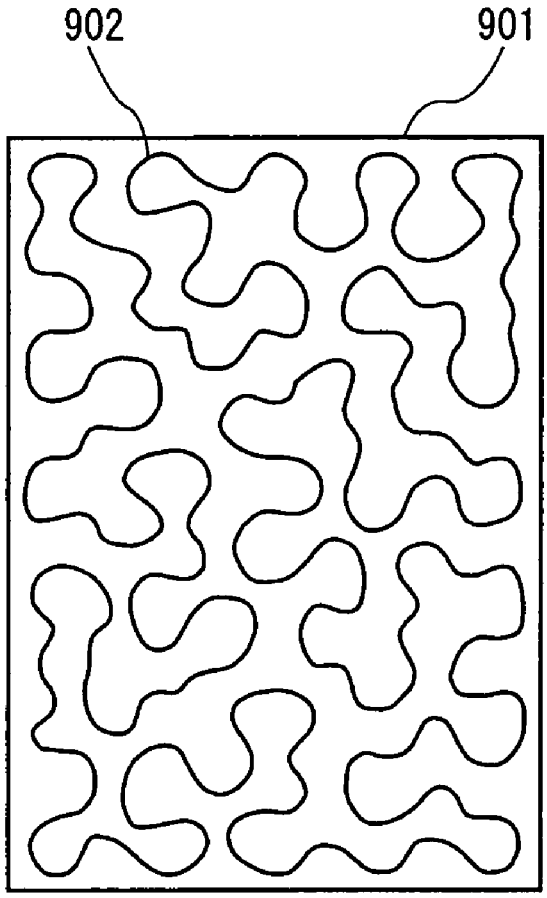
FIG. 40 is a schematic diagram showing a state where a stippling stitch has been sewn.

In the example shown in FIG. 39, on the divided curve 751, a needle drop point P701 may be disposed at the stitch path starting point P601, a needle drop point P700 may be disposed at the feature point P600, and six needle drop points may be evenly disposed between the needle drop point P701 and the needle drop point P700. Further, on the divided curve 752, the needle drop point P702 may be disposed at the stitch path ending point P602 and six needle drop points may be evenly disposed between the needle drop points P700 and the needle drop point P702.

In this example, a curve path is divided at a feature point into divided curves and the distance between the needle drop points along the divided curve are calculated based on a value stored in the stitch length storage area 1202. As a result, the needle drop points may be evenly disposed between the feature points, and between the feature point and the stitch path starting point or ending point, thereby enabling to obtain sewing data used to form stitches of a design having a high-quality shape.

As described above, a stitch path may be formed on a profile line network created from profile lines of unit areas without intersecting, so that the resulting stitch line does not intersect itself. Further, by avoiding these unit areas whose profile lines become too complicated, or mutually facing profile lines of which are too close to each other, the resulting stitch line should not have parts which are too close to each other. Also, the stitch path created on the profile line network may be moved on the profile lines of the unit areas until it may not be moved any more and thus may be arranged evenly in a sewing area in a well-balanced manner, thereby obtaining sewing data required to form stitches of a design having a high-quality shape.

The present disclosure is not limited to the above-described embodiment but, of course, may be modified variously. Although the above embodiment has employed a regular hexagon as a unit area, instead, a line-symmetrical hexagon may be employed. Preferably, the hexagon has a vertex with an angle smaller than 180 degrees. Other than a hexagon, the unit area may be a polygon such as a regular triangle, a rectangle, a rhomboid, a parallelogram, or a pentagon. When disposing the polygons as the unit areas, orientation of them need not be constant. Further, although the above embodiment has disposed the regular hexagons in such a manner as to fill the sewing area, there may be a gap between the unit areas as far as they are in contact with each other.

In the above-described embodiment the stitch path 410 evenly disposed in the sewing area 110 may be transformed through the transformation processing (S8 of FIG. 5), changed into a curve through the Bezier curve processing (S9), and then the needle drop points may be disposed on the curve, thereby creating stitch information. However, the stitch information may be created by disposing the needle drop points on a stitch path after the movement processing of S6 is completed. Alternatively, the stitch information may be created by disposing needle drop points on a stitch path after the special processing of S7 may be completed or it may be created by disposing needle drop points on a transformed stitch path after the transformation processing of S8 is completed.

In the above exemplary embodiment, one reference distance may be set and used to determine the size of the unit area and the radius of the circle when creating the transformed stitch path by moving the branch points. However, different values may be inputted for a reference distance for the size of the unit area and a reference distance for the radius of the circle. Rather than causing the user to enter the reference distance, a predetermined value may be used as the reference distance. Further, the reference distance may be determined on the basis of the area or the size of a sewing area.

In the above exemplary embodiment, the stitch path starting point may be determined as the branch point closest to the starting point. Instead of the branch point, a point on the side line segment closest to the starting point may be employed. This also holds true for the stitch path ending point. Similarly, although the starting point and the ending point are on the profile line 111 of the sewing area 110 in the embodiment, they may be set in the sewing area 110. Further, rather than making the user specify the starting point and the ending point, arbitrary points may be set by a program.

In the above-described embodiment, when creating the initial stitch path 310, branch points may be traced in the clockwise direction along the profile line of the sewing area 110. However, of course they may be traced counterclockwise.

In the movement processing (S6 of FIG. 5), the sequence of the branch points on the stitch path may be used as the argument by the random number generation program to obtain reproducibility. Any other value, for example, the coordinates of the branch point may be used instead. Further, values to be given as the arguments may be stored in an array so that those values may be used sequentially from the first one in the array. Further, the reproducibility may not always be required, and the argument may take on a different value each time. For example, a time may be used as the argument. Rather than using the random number generation program, an array storing values to be used in probability judgment may be stored beforehand so that the values may be sequentially read from the array and used. Further, rather than determining whether to move the stitch path based on the probability, the path may be actually moved for a predetermined number of times if any of the movement patterns applies. Further, instead of making determination on whether to move the stitch path, the stitch path may be moved each time any of the movement patterns applies.

In the above-described embodiment the vertexes of one unit area (regular hexagon), that is, the branch points on its profile line may be traced to determine whether the stitch path is to be moved. However, instead of tracing the branch points on the profile line of one unit area, the branch points on an outer periphery of a plurality of the unit areas may be traced to determine whether the stitch path may be moved.

In the above exemplary embodiment, all of the branch points on the stitch path 410 are moved to create the transformed stitch path 510. Rather than moving all the branch points, however, only some of the points may be moved. For example, only the branch points having sequences of even numbers or those as multiples of 3 may be moved, or it may be determined whether to move each of the branch points at a predetermined probability by a random number. Further, only the first movement or the second movement may be performed. Even further, it may be arranged such that only the first movement would be performed on some points, only the second movement would be performed on other points, and both the first movement and the second movement would be performed on the other points.

In the above-described embodiment, it may be determined whether to move the stitch path if the movement pattern A or B applies in the movement processing (S6 of FIG. 5 and FIG. 6), and different probabilities are employed in the "mode 1", "mode 2", and "mode 3" to determine to move the stitch path. The "mode 1", "mode 2", and "mode 3" may be applied in this order, whose probabilities increase stepwise in this order. This enables creating sewing data required to form stitches of a design having a well-balanced shape. The probabilities for these modes are not limited to those given in the above-described embodiment and a different value may be set for each mode. Further, a larger number of or a smaller number of modes may be provided. In such a case, it may also be preferable to set the probabilities such that the modes to be applied later correspond to higher probabilities, because it may shorten the processing time required until there is no more stitch path that may be moved. Also, the stepwise modes need not be provided.

In the "mode 1", when the movement pattern A applies, the case may be further classified into two cases according to whether its target point is on the initial stitch path 310 or not. Further, when the movement pattern B applies, the case may be classified into two cases according to whether the next clockwise branch point of the current target point has been newly determined as a point on the stitch path when the stitch path was moved because the movement pattern B applied, and the current target may be a vertex facing a vertex which was the target point in the regular hexagon when the stitch path was moved. As a result, different probabilities may be used for the different cases. The conditions for the classification based on the target point are not limited to the above-described conditions. The classification may be made based on other conditions, and in the larger number of cases.

When the movement pattern A or B applies, instead of determining whether to actually move the stitch path, the stitch path may be just moved every time the movement pattern A or B applies.

In the above-described embodiment, the probability in the mode 3 may be set to 1 for both of the movement patterns A and B. Consequently, the processing to move the stitch paths may be repeated until there is no more stitch path (which may be moved) to which the movement pattern A or B is applied. However, instead of repeating the processing until there is no more movable stitch path, the movement processing may be terminated even when there still remains a movable stitch path.

Further, the present disclosure is not limited to using the embroidery sewing machine 3 to sew a stippling stitch onto a work cloth held by the embroidery frame 31. For example, a stippling stitch may be sewn while a work cloth is moved by controlling the driving of a needle bar swinging mechanism (not shown) that swings the needle bar 35 horizontally and a feed dog mechanism (not shown) that drives the feed dog (not shown) back and forth or from front to back and from side to side, based on the embroidery data of the stippling stitches. Alternatively, the stippling stitch may be sewn by controlling the driving of only the feed mechanism without driving the needle bar mechanism.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A sewing data creation apparatus for creating sewing data used for sewing by a sewing machine, the apparatus comprising:

a profile line network creation device that continuously arranges unit areas with a predetermined shape in a sewing area to create a profile line network, the profile line network being an aggregate of profile lines of the arranged unit areas, the profile line network providing a basis for creating the stitch path;

a starting point-and-ending point determination device that determines a starting point and an ending point of the stitch path from a plurality of points on the profile line network;

a path creation device that creates the stitch path by connecting the starting point and the ending point on the profile line network without intersecting;

a movement determination device that determines whether a partial path may be moved in such a manner as to be routed longer on the profile line of at least one unit area where the partial path is disposed, the partial path being a part of the stitch path created by the stitch path creation device and continuously disposed on the profile line of at least one of the unit areas;

a movement device that moves the partial path determined to be moved by the movement determination device on the profile line of the at least one unit area;

an adjustment device that adjusts the stitch path by causing the movement device to move the partial path until there is no more partial path determined to be moved by the movement determination device; and a sewing data creation device that creates the sewing data used to form stitches on the stitch path adjusted by the adjustment device.

2. The sewing data creation apparatus according to claim 1, further comprising a transformation device that moves an arbitrary point on a sectioned path while two endpoints of the sectioned path are fixed, thereby transforming a shape of the sectioned path, the sectioned path being obtained by sectioning the stitch path adjusted by the adjustment device based on a predetermined condition.

3. The sewing data creation apparatus according to claim 2, further comprising a curve processing device that transforms the stitch path transformed by the transformation device into a curve.

4. The sewing data creation apparatus according to claim 3, wherein the curve processing device transforms the stitch path into a Bezier curve.

5. The sewing data creation apparatus according to claim 2, wherein:

the unit pattern is a hexagon; and the profile line network is an aggregate of side line segments which represent sides of the hexagons.

6. The sewing data creation apparatus according to claim 5, wherein:

the predetermined condition for the sectioned path is that the sectioned path is two continuous sides of the hexagon; and the transformation device moves a vertex of the hexagon formed by the two continuous sides as the arbitrary point on the sectioned path.

7. The sewing data creation apparatus according to claim 6, wherein the transformation device moves the vertex onto one side line segment not determined as the stitch path among three side line segments connected at the vertex.

8. The sewing data creation apparatus according to claim 6, further comprising:

a distance specification device that specifies a reference distance used as a reference when creating the stitch path, wherein the transformation device moves the vertex to an arbitrary point inside a circle having the vertex as a center and a radius determined on the basis of the reference distance specified by the distance specification device.

9. The sewing data creation apparatus according to claim 1, further comprising a curve processing device that transforms the stitch path adjusted by the adjustment device into a curve.

10. The sewing data creation apparatus according to claim 9, wherein the curve processing device transforms the stitch path into a Bezier curve.

11. The sewing data creation apparatus according to claim 1, wherein:

the unit area is a polygon; and the profile line network is an aggregate of side line segments that represent sides of the polygons.

12. The sewing data creation apparatus according to claim 11, wherein the polygon is a hexagon.

13. The sewing data creation apparatus according to claim 11, wherein the starting point-and-ending point determination device determines one branch point of branch points as the starting point and a second branch point of the branch points as the ending point, each branch point being a point at which a plurality of endpoints of the side line segments are positioned on the profile line network.

14. The sewing data creation apparatus according to claim 11, wherein the path creation device includes:

a first determination device that determines as the stitch path one side line segment which is positioned in a first predetermined direction from among the side line segments, each of the side line segments having an endpoint at the starting point;

a second determination device that determines as the stitch path one side line segment which diverges in a second predetermined direction from one endpoint of the side line segment determined to be the stitch path, the one endpoint being neither the starting point nor at the same position with another endpoint of another side line segment previously determined to be the stitch path;

a third determination device that, if the side line segment is intersected by the profile line of the sewing area, excludes from the stitch path a side line segment already determined to be the stitch path and that determines as the stitch path one side line segment which is not yet determined to be the stitch path from among the side line segments diverging from an endpoint of the excluded side line segment, the endpoint being positioned in the sewing area; and a termination device that terminates creation of the stitch path if the ending point exists on the side line segment determined as the stitch path.

15. The sewing data creation apparatus according to claim 14, wherein:

the path creation device includes a fourth determination device that, after a first side line segment is excluded from the stitch path a second side line segment is newly determined as the stitch path by the third determination device, and the second side line segment is further excluded from the stitch path by the third determination device, the fourth determination device determines as the stitch path a line segment which connects from a first branch point to a vertex facing the first branch point and being one of vertexes of a hexagon having the first and second side line segments as the profile line, the first branch point is an endpoint common to an original side line segment, the first side line segment, and the second side line segment, the first side line segment being one side line segment determined by the second determination device as the stitch path and the second line segment being one side line segment not yet determined to be the stitch path among the side line segments diverging from an endpoint of the excluded first side line segment positioned in the sewing area, and the original side line segment is a side line segment based on which the first side line segment is determined as the stitch path by the second determination device.

16. The sewing data creation apparatus according to claim 15, wherein the path creation device suspends creation of the stitch path if a part of the line segment determined as the stitch path by the fourth determination device exists outside the sewing area.

17. The sewing data creation apparatus according to claim 11, further comprising:

a path expansion device, the path expansion device determining a first line segment, a second line segment, and a third line segment as the stitch path if neither of a first outer side line segment and a second outer side line segment are intersected by the profile line of the sewing area, the path expansion device instead excluding a first path side line segment and a second path side line segment from the stitch path, wherein:

the first path side line segment and the second path side line segment are continuous two side line segments forming a part of the stitch path adjusted by the adjustment device and have a path branch point as a common endpoint thereof;

the first outer side line segment is a side line segment connected to an outer branch point on the profile line of a hexagon including the first path side line segment, the outer branch point being an endpoint other than the path branch point of a connection side line segment, the connection side line segment not being a part of the stitch path and being connected to the path branch point;

the second outer side line segment is a side line segment connected to the outer branch point on the profile line of a hexagon including the second path side line segment;

the first line segment is a line segment connecting a first endpoint and a second endpoint, the first endpoint being an endpoint other than the path branch point of the first path side line segment and the second endpoint being an endpoint other than the outer branch point of the first outer side line segment;

the second line segment is a line segment connecting a third endpoint and a fourth endpoint, the third endpoint being an endpoint other than the path branch point of the second path side line segment and the fourth endpoint being an endpoint other than the outer branch of the second outer side line segment; and the third line segment is a line segment connecting the second endpoint and the fourth endpoint.

18. The sewing data creation apparatus according to claim 1, further comprising:

a distance specification device that specifies a reference distance used as a reference when creating the stitch path, wherein a size of the unit area is determined based on the reference distance specified by the distance specification device.

19. The sewing data creation apparatus according to claim 18, further comprising:

a first distance adjustment device that decreases the reference distance specified by the distance specification device by a predetermined amount if the profile line network creation device is unable to arrange even one unit area in the sewing area, wherein the profile line network creation device creates the profile line network at least a second time based on the reference distance decreased by the predetermined amount by the first distance adjustment device.

20. The sewing data creation apparatus according to claim 11, further comprising:

a distance specification device that specifies a reference distance used as a reference when creating the stitch path; and a second distance specification device that decreases the reference distance specified by the distance specification device by a predetermined amount if the number of vertexes of the polygon on the stitch path created by the path creation device is less than a predetermined number, wherein:

the profile line network creation device creates the profile line network at least a second time based on the reference distance decreased by the predetermined amount by the second distance adjustment device; and the path creation device creates the stitch path on the profile line network created at least a second time by the profile line network creation device.

21. The sewing data creation apparatus according to claim 1, further comprising a uniforming device that makes uniform the length of the stitches which are disposed on the stitch path.

22. A computer-readable recording medium storing a program for creating sewing data used for sewing by a sewing machine, the program comprising instructions that cause a controller to execute:

profile line network creation instructions for continuously arranging unit areas with a predetermined shape in an entire sewing area to thus creating a profile line network, the profile line network being an aggregate of profile lines of the unit areas and provides a basis for creating a stitch path;

starting point-and-ending point determination instructions for determining a starting point and an ending point of the stitch path from among points on the profile line network;

path creation instructions for creating the stitch path by connecting the starting point and the ending point on the profile line network without intersecting;

movement determination instructions for determining whether a partial path may be moved in such a manner as to be routed longer on the profile line of the at least one unit area where the partial path is disposed, the partial path being a part of the stitch path created in the path creation instructions and continuously disposed on the profile line of at least one of the unit areas;

movement instructions for moving the partial path determined to be moved in the movement determination instructions in such a manner that the partial path is routed longer on the profile line of the at least one unit area;

adjustment instructions for adjusting the stitch path by repeating the movement step to move the partial path until there is no more partial path determined to be moved in the movement determination step; and sewing data creation instructions for creating the sewing data used to form stitches on the stitch path adjusted in the adjustment instructions.

* * * * *